US005713095A

United States Patent [19]

Wakat

[11] Patent Number: 5,713,095

[45] Date of Patent: Feb. 3, 1998

[54] BIFURCATED PAINT ROLLER AND PAINTING METHOD

[75] Inventor: George H. Wakat, St. Paul Park, Minn.

[73] Assignee: Incredicoat, Inc., Oakdale, Minn.

[21] Appl. No.: 655,408

[22] Filed: May 30, 1996

[51] Int. Cl.[6] ..... B05C 1/08

[52] U.S. Cl. ..... 15/230.11; 15/257.06; 220/553; 492/13; 492/19

[58] Field of Search ..... 15/230.11, 230.14, 15/257.06; 206/229, 575; 220/553, 697; 492/13, 19

[56] References Cited

U.S. PATENT DOCUMENTS

| | | | |
|---|---|---|---|
| D. 230,086 | 1/1974 | Meisner . | |
| D. 332,512 | 1/1993 | Bernard . | |
| 2,321,511 | 6/1943 | Piercy . | |
| 2,693,893 | 11/1954 | Rice et al. | 492/13 |
| 2,799,884 | 7/1957 | Bedford . | |
| 2,838,781 | 6/1958 | Molle . | |
| 2,881,461 | 4/1959 | Parker . | |
| 2,909,797 | 10/1959 | White . | |
| 3,554,659 | 1/1971 | Stokes . | |
| 3,562,837 | 2/1971 | Baginski et al. . | |
| 3,609,049 | 9/1971 | Smyth . | |
| 3,649,986 | 3/1972 | Dahlund . | |
| 3,745,624 | 7/1973 | Newman . | |
| 3,970,396 | 7/1976 | Brady . | |
| 4,164,299 | 8/1979 | Fuhr . | |
| 4,191,792 | 3/1980 | Janssen . | |
| 4,257,140 | 3/1981 | Downing | 15/230.11 |
| 4,434,521 | 3/1984 | Martin et al. . | |
| 4,467,509 | 8/1984 | Dezen . | |
| 4,897,893 | 2/1990 | Barker . | |
| 4,937,909 | 7/1990 | Georgiou . | |
| 5,117,529 | 6/1992 | Ohta . | |
| 5,167,055 | 12/1992 | Stoddart et al. . | |
| 5,178,274 | 1/1993 | Long . | |
| 5,206,979 | 5/1993 | Campbell . | |
| 5,386,611 | 2/1995 | Kim . | |
| 5,437,593 | 8/1995 | Gustavsen . | |
| 5,471,703 | 12/1995 | Niven . | |
| 5,511,279 | 4/1996 | Ippolito . | |

FOREIGN PATENT DOCUMENTS

| | | | |
|---|---|---|---|
| 9002017 | 4/1991 | Netherlands | 15/230.11 |

OTHER PUBLICATIONS

Harrington et al., Color: A Stroke of Brilliance, unknown, pp. 104–107 (Tri–Roller Technique), Benjamin Moore & Co., N.J. (Copyright 1993 and 1995).

*Primary Examiner*—Terrence Till

[57] ABSTRACT

A bifurcated paint roller and painting method using such. The paint roller is a hand tool having two roller portions, which each of the roller portions having a nap for picking up and spreading paint. The roller portions are spaced transversely from each other and rotate independently of the other. A paint pan is provided with the bifurcated paint roller and is itself bifurcated. The paint pan includes two receptacle portions, each of which holds a paint having a different characteristic. A divider separates the receptacle portions such that the paints having the different characteristics are prevented from mixing. The distal end of the hand tool includes an open ended slot for reception of the divider such that each of the roller portions is dippable into their respective paints. Alternatively, the hand tool may include tubes mounted thereon and feeding paint to the roller portions. A painting method includes the steps of applying a paint having a first characteristic to a surface, rolling the roller portions with paint having respective second and third characteristics across the surface, and pressing and removing a plastic sheeting to the surface immediately after either or both of the painting steps. The hand tool and method provides a quick and easy method of achieving an effect identical to sponge or rag painting. Especially preferred for the first characteristic is a texture, and especially preferred for the second and third characteristics are second and third micaceous materials to achieve mixed pearlescent effects.

25 Claims, 17 Drawing Sheets

BIFURCATED PAINT ROLLER AND PAINTING METHOD

BACKGROUND OF THE INVENTION

The present invention relates generally to painting, particularly to hand tools and methods for painting, and specifically to a bifurcated paint roller and painting method using such.

Sponge painting and rag rolling painting are popular. The effects achieved by these methods of painting are considered aesthetic to a great number of people. The randomness of the colors, shades and patterns is considered attractive. However, sponge painting and rag rolling are labor intensive methods and hence are expensive.

Wallpaper having the sponge or rag rolling effect is available. However, wallpaper has its own problems. For example:

- wallpaper seams are undesirable and bubbles appear in wallpaper;
- the randomness effect is not truly random, since the same random pattern appears on each sheet or roll of wallpaper;
- wallpaper is expensive; the manufacturer has massive start up costs and these costs are passed down to the consumer;
- wallpaper is paper—it is easily damaged and torn;
- the pattern is applied to the wallpaper by ink, which is thin; when tape is applied to the wallpaper and stripped off, the ink pattern also may come off; and
- it is difficult if not impossible to repair the damage to the wallpaper or damage to the inked pattern; walls typically have to be repapered.

SUMMARY OF THE INVENTION

General objects of the present invention are to provide a unique hand tool for painting and unique methods of painting.

Another object of the present invention is to provide a hand tool which is uniquely bifurcated. Specifically, the hand tool includes a pair of roller portions spaced transversely from each other. Each roller portion is rotatable independently from the other roller portion. By randomly rolling the paint-dipped roller portions on a surface, a sponge or rag rolling effect is achieved where each roller has a paint of a different color or characteristic.

Another object of the present invention is to provide is to provide a unique open ended slot in the bifurcated roller. Such a slot permits the use of a unique paint pan which includes a pair of paint receptacle portions separated by a wall or divider. The slot receives the divider and each of the roller portions is received by a respective receptacle portion such that paints of different color, or of different characteristics, may be poured into the receptacle portions without mixing with each other.

Another object of the present invention is to mount tubes of paint on the hand tools, with each of the tubes holding a paint of a different color or characteristic. Each of the tubes includes an outlet fluidly connected to an inlet of one of the roller portions. The inlet may include a swivel nozzle mounted on an axis of the roller and at the apex of a hopper or endless hopper whose top or cover is the cylindrical nap of the roller.

Another object of the present invention is to provide unique nap portions about at least one of the roller portions.

The nap portions are spaced from each other and may extend partially or entirely about the circumference of the roller portion. The nap portions may form patterns of regular or irregular shapes.

Another object of the present invention is to provide a unique relationship between the roller portions and the frame arrangement of the hand tool. The distal end of the frame arrangement permits the rollers to be adjustable in the axial direction to permit the ends of the rollers which face each other to be moved toward and away from each other. Such a spacing between the rollers affects the pattern being applied to the surface.

Another object of the present invention is a method of painting which uniquely applies at least two paints of different colors or characteristics simultaneously to a surface, applying a sheeting to the wall while the paints is still wet, applying a pressure to the sheeting while the paints are still wet, and removing the sheeting while the paints are still wet to further randomnize the paint patterns applied to the surface.

Another object of the present invention is to uniquely apply the sheeting to a wet textured base paint, remove the sheeting, permit the base paint to dry, simultaneously apply two paints of different characteristics to the base paint, and optionally again apply and remove a sheeting.

Another object of the present invention is to uniquely apply two paints having different micaceous materials therein simultaneously to a surface with the bifurcated roller to obtain a mixed pearlescent effect.

Another object of the present invention is to use a polyurethane based paint.

An advantage of the present invention is that a sponge or rag rolling effect may be achieved without a sponge or a rag and without applying wallpaper.

Another advantage of the present invention is that a sponge or rag rolling effect may be achieved simply, quickly, and inexpensively.

Another advantage is that repairs may be made to the painted surface simply, quickly, and inexpensively. The randomness of the patterns to the painted surface permits the repair to blend into the painted surface.

These and further objects and advantages of the present invention will become clearer in light of the following detailed description of the illustrative embodiments of this invention described in connection with the drawings.

Figure 1:
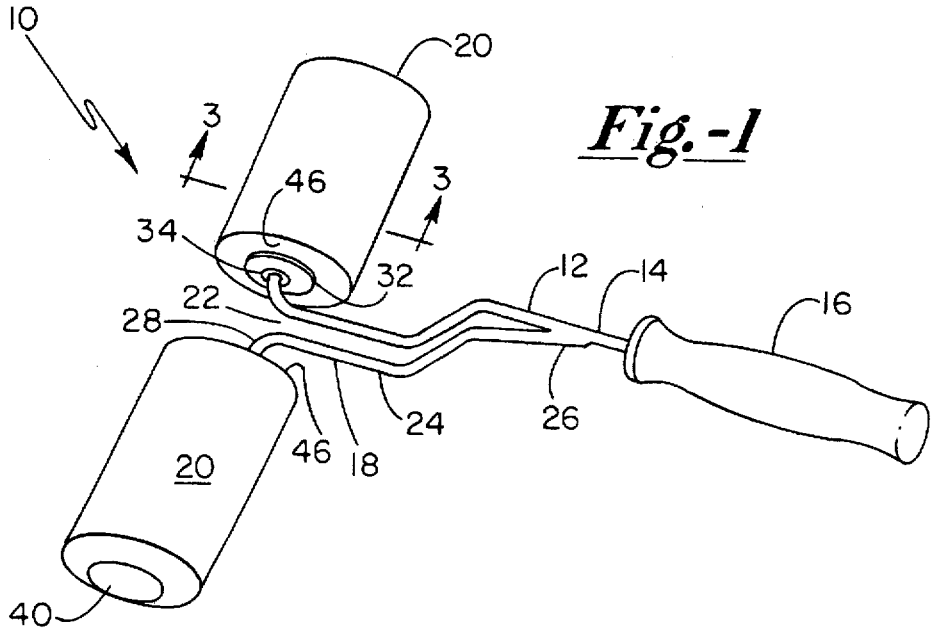
FIG. 1 shows a perspective view of the bifurcated roller of the present invention.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "upwardly", "downwardly", and "sidewardly" and similar terms are used herein, it should be understood that these terms have reference only to the structure shown in the drawings as it would appear to a person viewing the drawings and are utilized only to facilitate describing the preferred embodiments.

DESCRIPTION

As shown in FIGS. 1, the present bifurcated roller is indicated in general by the reference numeral 10. It includes a frame arrangement 12 having a proximal end portion 14 having a handle or grip 16 affixed thereto and a distal end portion 18 having rotatably mounted thereto a pair of roller portions 20. The distal end portion 18 is bifurcated and includes an open-ended slot 22. The distal end portion 18 includes a pair of generally L-shaped metal rods 24 welded at a junction 26 and having an integral end 28 on which one roller portion 20 is mounted. If desired, each of the rods 24 may have one or more bends therein between the handle 14 and the roller portions 20. The roller portions having axes which are aligned with each other.

Figure 2:
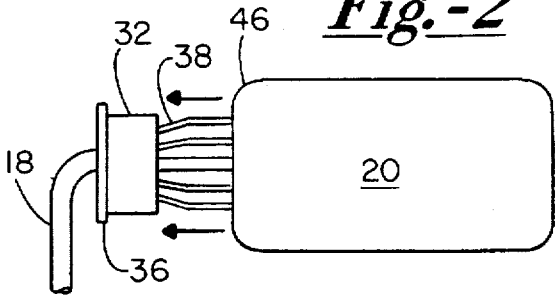
FIG. 2 shows a roller portion of the bifurcated roller of FIG. 1 and illustrates the axial adjustment of the roller portion.
Figure 3:
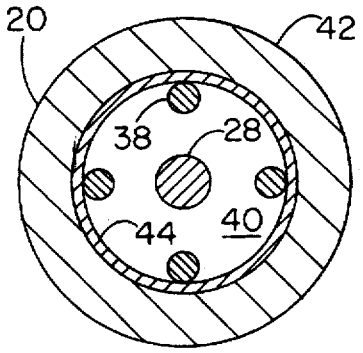
FIG. 3 is a section at lines 3—3 of FIG. 1.

As shown in FIGS. 1 and 2, a plastic roller mount 32 is rotatably engaged to each of the rods or shafts 24 and is prevented from axial movement in one direction by a washer 34 fixed to each of the rods 24. An annulus 36 integral with and on each of the roller mounts 32 prevents axial movement of its respective roller portion 20 toward the slot 22. Four bars 38 for further mounting one of the roller portions 20 are fixed in and extend between the proximal disk like roller mount 32 and a respective distal plastic roller mount 40. Mount 40 is similar to mount 32 except that mount 40 lacks the annulus 36 to permit the roller portion 20 to be slid onto the bars or cage 38. Ends of the bars 38 angle inwardly toward their respective mount 32 or 40. The roller portion 20 includes a nap 42 affixed to a cylindrical base 44. As shown in FIG. 3, the bars 38 frictionally engage the base 44, thereby permitting proximal end portions 46 of the roller portions 20 to be adjusted to and away from each other, and to stay fixed at the adjusted position for painting. A preferred spread between the proximal end portions 46 falls in the range of between about two inches and about five inches. The nap 42 may be fleece or mohair. The radial length of the nap 42 may fall in a range of between about ⅛ inches and 1½ inches.

Figure 4:
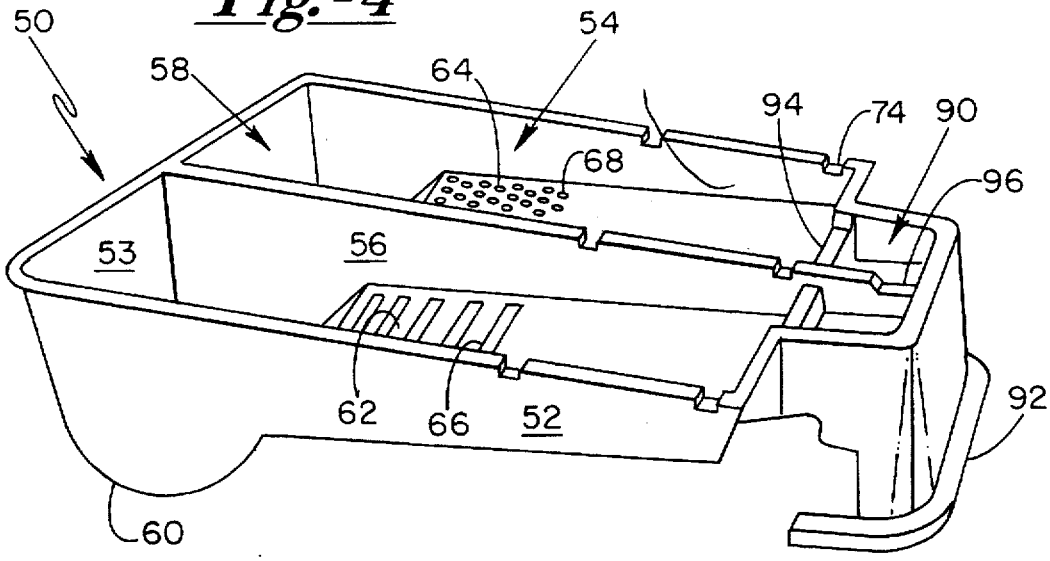
FIG. 4 shows a paint receptacle for the bifurcated roller of FIG. 1.
Figure 5:
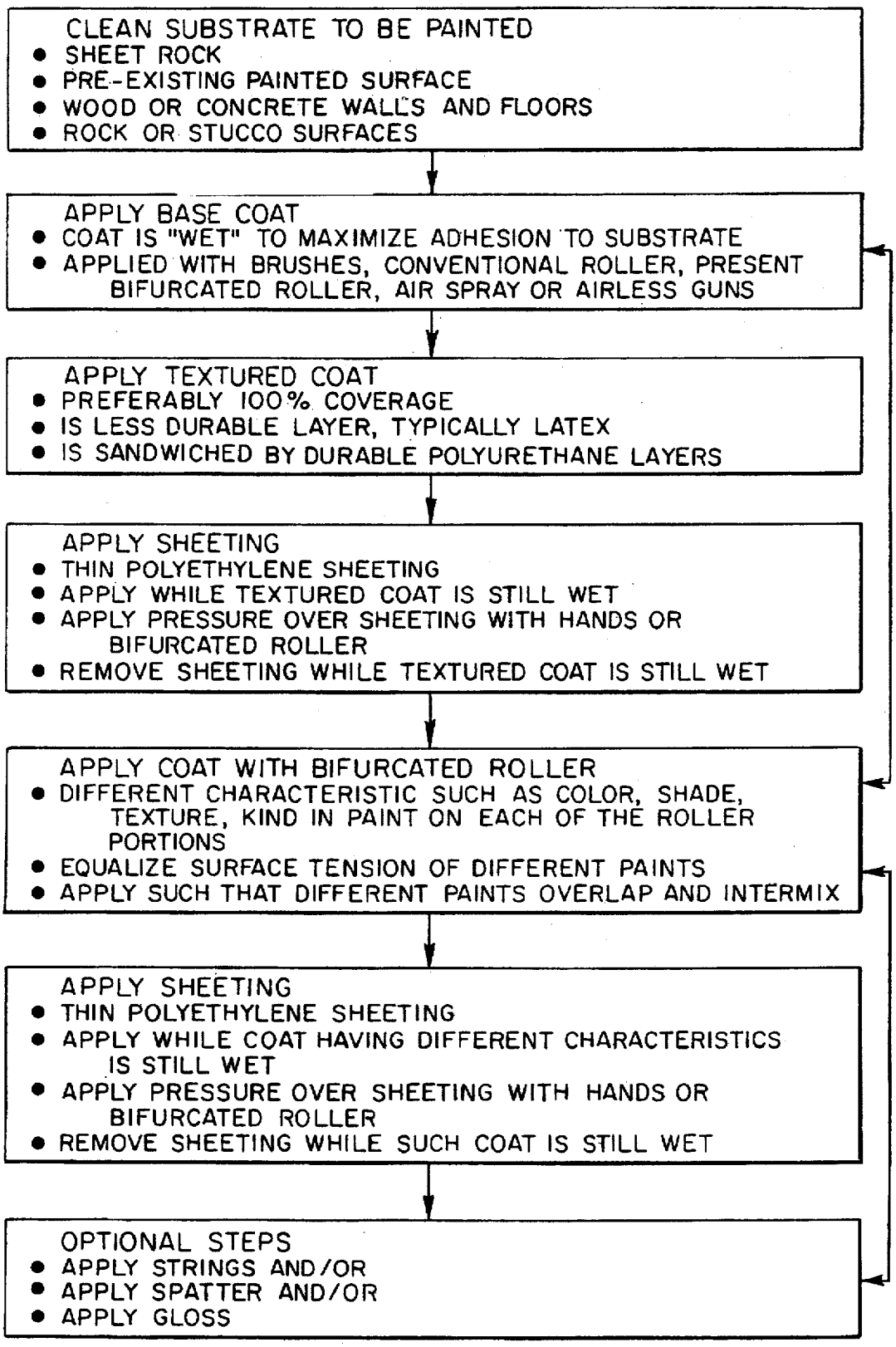
FIG. 5 shows a flow chart for the steps of various painting methods for use with the bifurcated roller of FIG. 1.

As shown in FIG. 4, an integrally molded paint receptacle or pan 50 includes two outer sidewalls 52 and two end walls 53 forming two main receptacle portions 54 separated by a divider or interior wall 56. Interior wall 56 includes a thickness less than the width of the slot 22 and the depth of the slot 22 is greater than the height of the interior wall 56 at the deep, curved portion 60 to permit the slot 22 to receive the interior wall 56 and to permit the roller portions 20 to be frilly dippable into the receptacle portions 60. A relatively deep receptacle portion 58, having a carved bottom 60 to reflect the curvature of the roller portions 20, extends between the sidewalls 52. The curved bottom 60 serves as a first supporting end for the pan 50. The curved bottom 60 leads into roughened floor portions 62, 64. Floor portion 62 may include raised rib like portions 66 and floor portion 64 may include raised knobs or bumps 68. Preferably, each of the floor portions 62, 64 includes the same roughened surface, i.e., either the ribs or the knobs. However, for purposes of illustration, one floor portion is shown with ribs and the other floor portion is shown with knobs. The roller portions 20 are rolled on the roughened floor portions 62, 64 to wipe off excess paint off the roller portions 20. Further, after being dipped into the deep portions 58, about one-half of each of the roller portions 20 may be weighted down with excess paint, and such an excess prevents the roller portions 20 from rolling. Rolling the roller portions 20 on the roughened surfaces 66 and 68 initiates such a rolling.

A tray 70 may be mounted on the sidewalls 52 and interior wall 56 for providing another roughened surface upon which the roller portions 20 may be rolled. The tray includes a pair of legs 72 which snap or friction fit into recesses 74 formed in the sidewalls 52 and interior wall 56. The tray 70 is integrally molded and includes channels 76 having holes 78. The channels 76 form diamond shaped surfaces 80 having edges 82. When the roller portions 20 are rolled on the tray 70, the excess paint is wiped off the roller portions 20 by the edges 82. The excess paint flows into the channels 76 and then drips back into the pan 50 via the holes 78.

A pair of receptacle portions 90 are formed in the pan 50 adjacent to a second supporting end 92 of the pan 50. The receptacle portions 90 are formed by relatively low interior end walls 94 and a relatively low dividing interior wall 96. Wall 94 is relatively low to permit paint which is poured into one of the portions 90 to flow into its respective receptacle portion 54. Dividing wall 96 is relatively low to permit a single brush to be dipped into both of the receptacle portions 90 at the same time and pick up paints having different colors, or different characteristics, at the same time.

Figure 13:
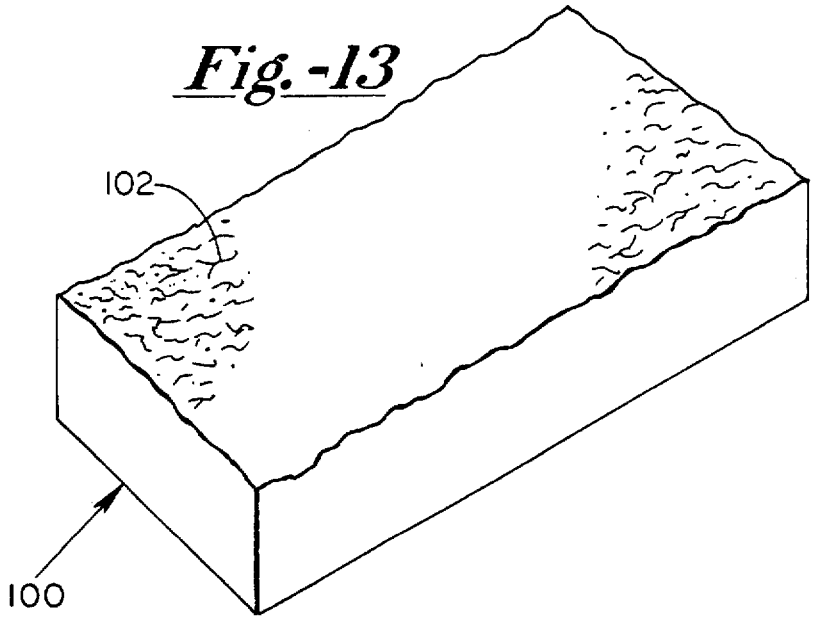
FIG. 13 shows a masonry block having a rough surface paintable by the present bifurcated roller.

The method of the present invention includes choosing and cleaning the substrate to be painted. The substrate includes sheet rock, pre-existing painted surfaces, wood walls and floors and cabinets, concrete walls and floors, and rock or stucco walls and floors or other surfaces. Decorative block 100 having a rough paintable surface 102 is shown in FIG. 13 and is an example of a surface other than a flat wall or floor that may be painted with the bifurcated roller 10. Painting surface 102 preferably includes using a longer nap, on the order of 1¼ inches, and perhaps a greater amount of paint.

The next step in the present method is preferably the application of a base coat to the substrate. The base coat is preferably a latex (emulsion), acrylic-based, alkyd, oil-based, epoxy, chlorinated robber, Portland cement, paint for metal such as aluminum paint, or texture paint, and more preferably a water-based polyurethane. The base coat may be applied with brushes, a conventional roller, air spray or airless guns, or the present bifurcated roller. After application of the base coat, the base coat is permitted to dry.

An optional subsequent step is the application of a textured coat on the base coat. The textured coat preferably is a water-based polyurethane, acrylic-based, alkyd, oil-based, epoxy, chlorinated rubber, Portland cement, paint for metal such as aluminum paint, or texture paint, and more preferably a latex (emulsion) paint, having a thickening agent such as one or more of the thickening agents of calcium carbonate, clay, or aluminum hydrate. The textured coat may be applied with brushes, a conventional roller, air spray or airless guns, or the present bifurcated roller. Substantially immediately after application of the textured coat and while the textured coat is still wet, sheeting is pressed on the textured coat. The sheeting is preferably plastic, and more preferably a polyethylene sheeting about one rail in thickness. When such sheeting is applied, such sheeting invariably and preferably includes folds, creases, and/or air pockets; such irregular application of the sheeting is preferred. The sheeting is pressed on and over the textured coat with hands, a conventional roller, or the present bifurcated roller. The sheeting is then removed while the textured coat is still wet. When removed, the sheeting itself removes some of the textured coat, which is stock to the underside of the sheeting. Removal of the sheeting leaves a variegated, somewhat rough topography to the textured coat.

The next preferred step is application of at least a two color coat, or two characteristic coat, with the present bifurcated roller 10. Such a step may directly follow the step of applying the base coat, or may directly follow the step of applying the texture coat and sheeting. The paints of this step are preferably oil, latex, or epoxy, and more preferably a water-based polyurethane. The application of a water-based polyurethane by this step sandwiches the preferred, though less durable textured latex coat, between two durable water-based polyurethane layers.

This step includes the application of at least two paints or coatings, each having a different characteristic, and each applied by a different roller portion 20, each of which picks up the paint from a different receptacle portion 58. The coatings preferred are adhesives, cleaning compounds, stripping compounds which have different characteristics which may be applied separately to a surface, and more preferably are paints having different characteristics. In the case of paints, such different characteristics preferably include texture, kind (such as latex, oil, epoxy, or water-based polyurethane), or surface tension, and more preferably include color or shade. Most preferably, the different characteristics includes different micaceous paints, i.e. paints having pearlescent pigments.

Prior to being coated on either the base coat or textured coat, the surface tensions of the paints having at least one different characteristic are then equalized. Without equalizing the surface tension of the paints, one of the paints may run at a greater rate than the other paint; one of the paints will drip down or across the substrate. The surface tension of the paints or coatings are equalized by adding thickening or thinning agents. Thickening agents include calcium carbonate, clay, or aluminum hydrate. Thinning agents include solvents or diluents such as hydrocarbons. It should be noted that as well as being equalized, the surface tension of the paints may be raised, such as to about 140 to 150 Krebs to provide a thicker two-paint coating.

After the surface tension of the paints having the different characteristics (or the coatings having the different characteristics) have been substantially equalized, or other features of the coats have been equalized so as to make the paints compatible to be spread wet simultaneously, the paints are poured into respective receptacles 58, or into respective receptacles 90 from which the paints may flow into their respective receptacles 58. The bifurcated roller 10 is then dipped into pan 50 such that each of the roller portions 20 picks up paint from a different receptacle portion 58. Then the roller portions 20 are rolled on the roughened surfaces 66, 68 to wipe excess paint off the roller portions 20.

Figure 6:
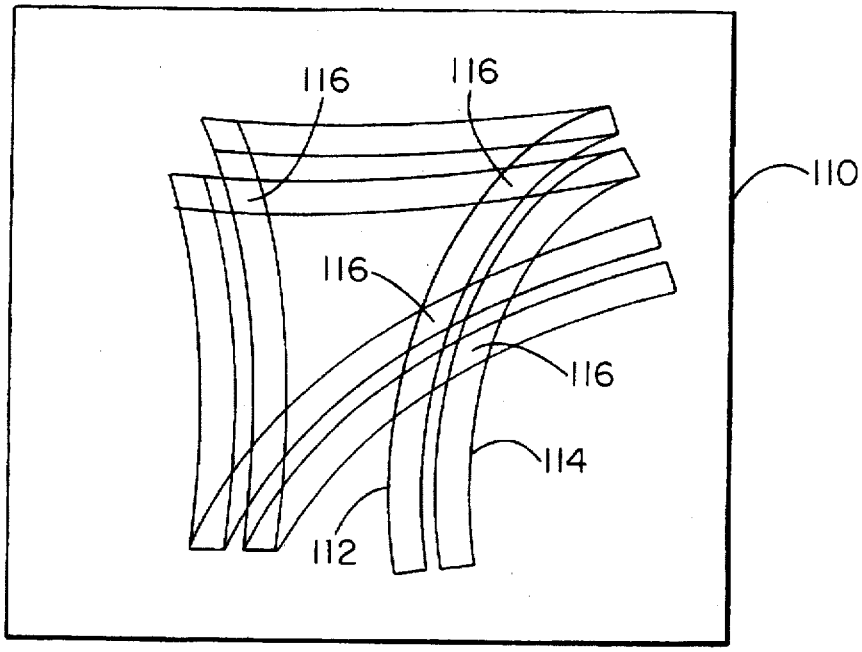
FIG. 6 is an elevation view of one way to manipulate the roller of FIG. 1 on a surface.

Then, as shown in FIG. 6, the bifurcated roller 10 is rolled on a substrate 110. Reference numbers 112, 114 represent respective bands of paint left by the adjacent but separated roller portions 20. Reference number 116 represents a portion where the bands 112, 114 have overlapped and intermixed. Portion 116 may have been formed by band 112 overlapping band 114 or vice versa. The process of rolling the adjacent but separated roller portions 20 continues until the desired effect is formed on the substrate 110. The base or textured coat may be partially or completely covered. It should be noted that as the roller 10 is turned, the outer roller portion 20 rotates at a faster rate than the inner roller portion 20; such an independent axis for each color characteristic advantageously provides for a greater random effect.

Figure 7:
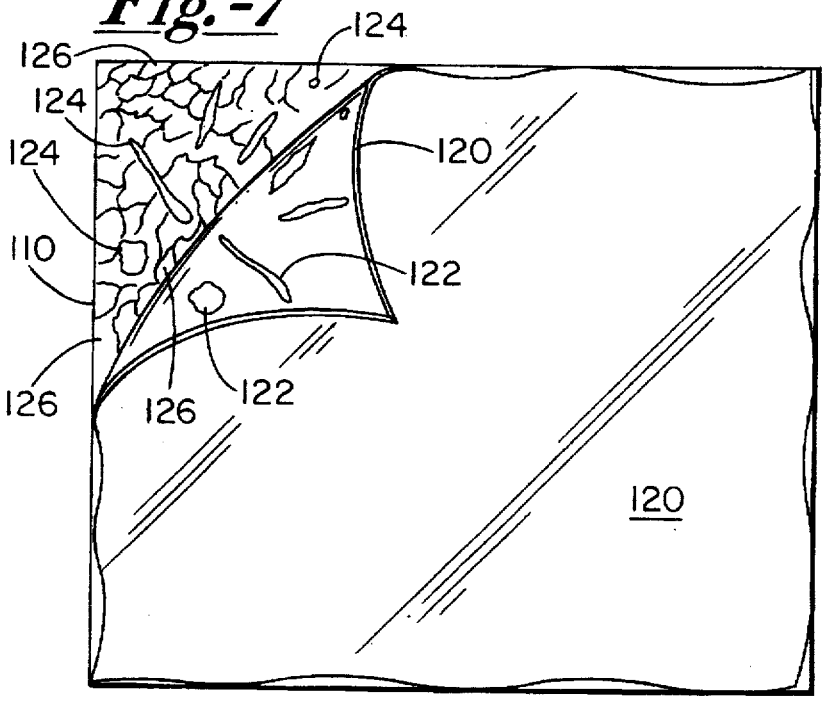
FIG. 7 is an elevation view showing the partial removal of sheeting applied to a surface.
Figure 8:
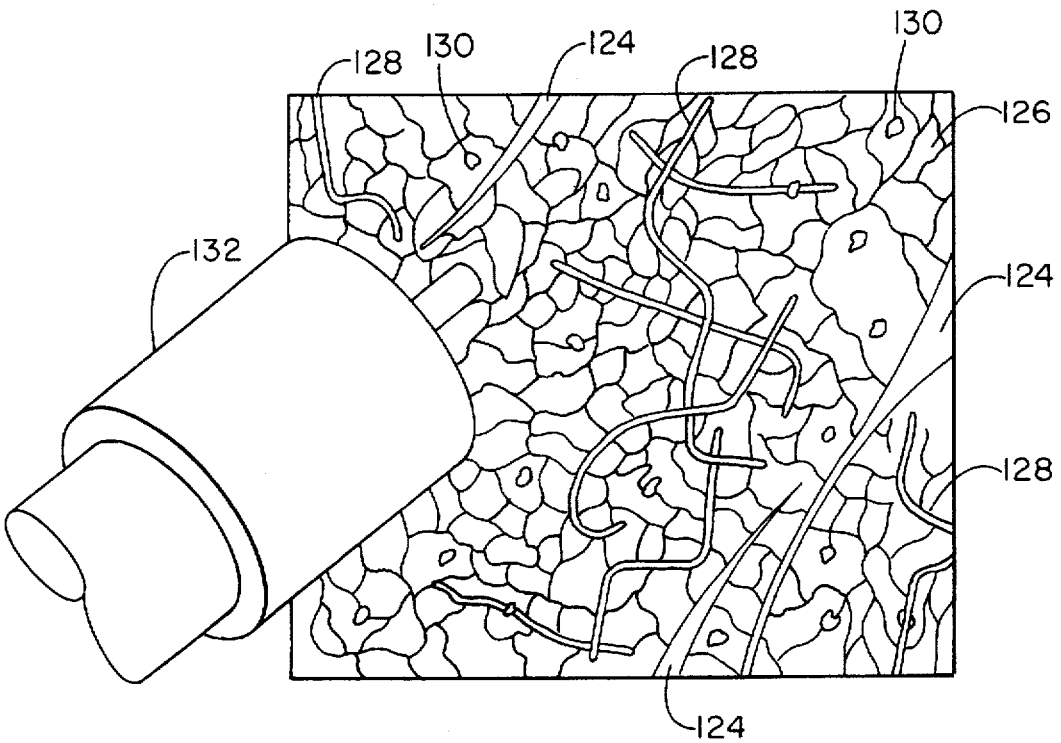
FIG. 8 shows an elevation view of a surface having strings and spatters applied by a paint spray gun.
Figure 9A:
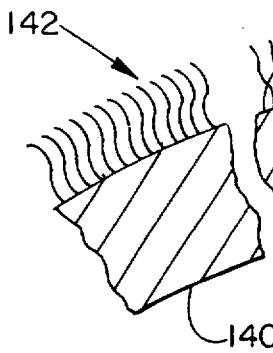
FIGS. 9A–D show section views of different types of naps.
Figure 9B:
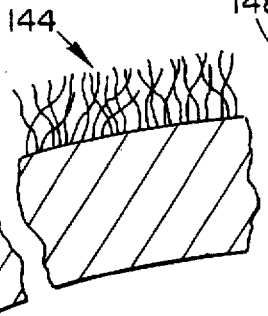
Figure 9C:
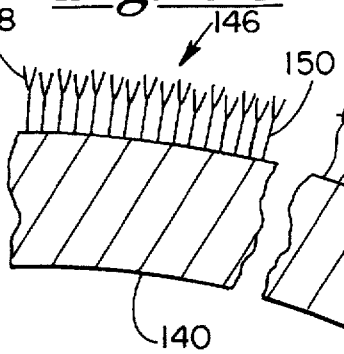
Figure 9D:
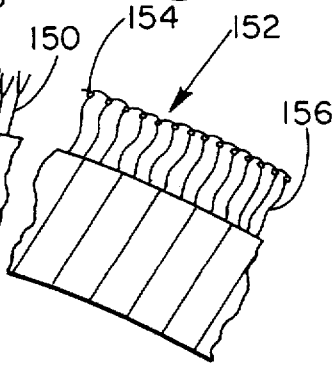

After the two characteristic coating has been applied to the substrate 110 and while the two characteristic coating is still wet, a sheeting 120 may be applied or pressed onto the two characteristic coating. The sheeting 120 is preferably plastic, and more preferably a polyethylene sheeting about one rail in thickness. When such sheeting 120 is applied, such sheeting 120 invariably and preferably includes folds, creases, and/or air pockets; such irregular application of the sheeting 120 is preferred. The sheeting 120 is pressed on and over the two characteristic coating with hands, a conventional roller, or the present bifurcated roller. The sheeting 120 is then removed while the two characteristic coating is still wet. When removed, the sheeting 120 itself removes some of the two characteristic coating, which is stock to the underside of the sheeting 120. Removal of the sheeting leaves a variegated, random, and/or irregular look to the two characteristic coating. As shown in FIG. 7, reference numerals 122 represent some of the two characteristic coating which has been removed by the sheeting 120 to expose a portion 124 of the base or textured coating. Portions 126 on substrate 110 represent areas where the bands 112, 114: 1) have not covered the base or textured coat or 2) have been rolled on the base or textured coat without overlapping another band or having been overlapped by another band or 3) have overlapped another band or have been overlapped or 4) have overlapped or have been overlapped more than once.

It should be noted that the step of applying a sheeting to the textured coat is substantially the same as the step of applying sheeting to the two characteristic coat. Such steps are represented in FIG. 7. In applying the sheeting, if a greater amount of coating, such as base coat, textured coat, or two characteristic coat, is to be removed, the sheeting is left on the underlying coat for a greater period of time to permit a greater amount of paint to dry and stick to the sheeting.

Optional subsequent steps may be taken either directly after application of the two characteristic coat and the drying of such, or after the removal of the sheeting 120 and the drying of its variegated two characteristic coat. These optional steps may include the application of strings of paint, of paint spatters, or the application of gloss. Strings are represented by reference numerals 128 and spatters by reference numerals 130. Variegations are represented by reference numeral 124. The strings 128 and spatters 130 may be applied by a spray gun 132.

FIGS. 9A–D show different types of naps. Each of the naps includes a cylindrical base 140. Reference number 142 indicates a new nap where the fleece or hairs run in a wavy, parallel fashion. Paint absorption of nap 142 is relatively great. Paint is spread upon the substrate, rather than being thrown on the substrate. Nap 144 is matted; the fleece or hairs have become stuck together over time. Paint absorption of nap 144 is relatively small. Instead of being spread upon the substrate or underlying coat, paint is thrown upon the substrate. Such a throwing of paint is preferred. Nap 146 includes flags or split hairs 148 which decrease the absorption potential of nap 146. While paint may be absorbed in a nonsplit underlying layer 150 of the nap 146, paint absorption of nap 146 is relatively low. Paint is thrown, rather than being spread, by nap 146. Nap 152 is similar to nap 146 in that it includes a layer 154 of little absorbency where the tips of the hairs have intertwined and/or become matted and a layer 156 of greater absorbency where the hairs lie parallel to each other. The parallel and/or wavy hair portions 150 and 156 (and the hairs of nap 142) may act like capillaries which readily draw up and absorb paint. The matted, flagged, or intertwined portions 148 and 154 (and the hairs of nap 144) lack such capillaries, and may thus be less absorbent.

Figure 10:
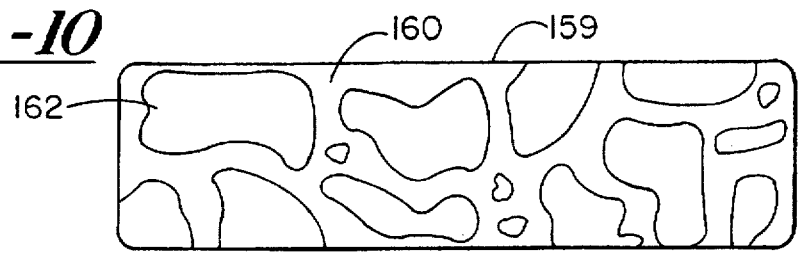
FIG. 10 shows an elevation view of another preferred roller portion of the present invention having irregular nap portions spaced apart to pick up and spread paint.
Figure 11:
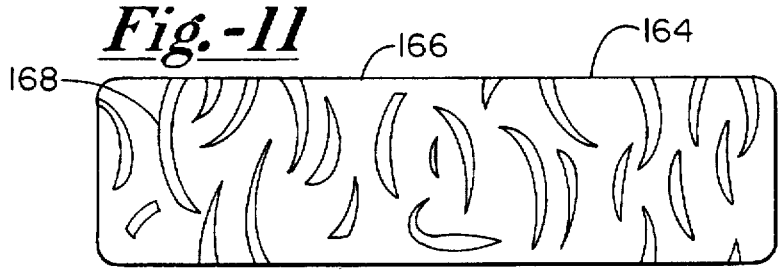
FIG. 11 shows an elevation view of another preferred roller portion of the present invention having irregular nap portions spaced apart to pick up and spread paint.

FIGS. 10 and 11 represent roller portions wherein the naps are comprised of nap portions. FIG. 10 shows a roller portion 159 having a cylindrical base 160 for engaging the cage 38 and further having raised nap portions 162 formed of mohair approximately ¼ inches in height. Mohair is a type of hog hair imported from China and is preferred for use with the present invention. Nap portions 162 have irregular peripheries. Roller portion 159 may be paired with another roller portion having a layout identical to the nap portions 162, or with another roller portion having nap portions 162 of the same general shapes but laid out differently, or with a nap having a standard cylindrical shape as shown in FIG. 1, or with a roller portion having nap portions of a different shape.

FIG. 11 shows a roller portion 164 having a cylindrical base 166 for engaging the cage 38 and further having raised nap portions 168 formed of mohair approximately ¼ inches in height. Nap portions 168 have irregular peripheries. Like roller portion 159, roller portion 164 may be paired with another roller portion having a layout identical to the nap portions 168, or with another roller portion having nap portions 168 of the same general shapes but laid out differently, or with a nap having a standard cylindrical shape as shown in FIG. 1, or with a roller portion having nap portions of a different shape such as roller portion 159.

Figure 12:
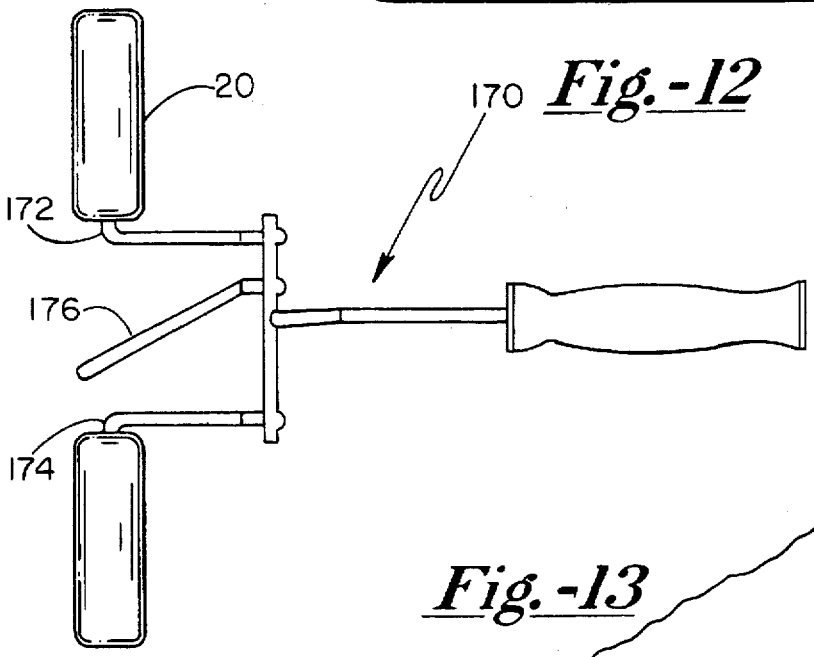
FIG. 12 shows a top view of an alternate embodiment of the bifurcated roller where three roller portions may be used.

FIG. 12 shows another roller embodiment 170 capable of mounting three spaced apart roller portions 20. The roller 170 includes a frame arrangement having two axially aligned and spaced apart shafts 172, 174 and a third non-aligned shaft 176 upon which a roller portion 20 may be mounted with washers 34 and plastic mounts 32 and 40 or with washers 34 and the plastic bodies 206 noted below. Such a third roller portion may contribute to the randomness of the desired end product.

Figure 14:
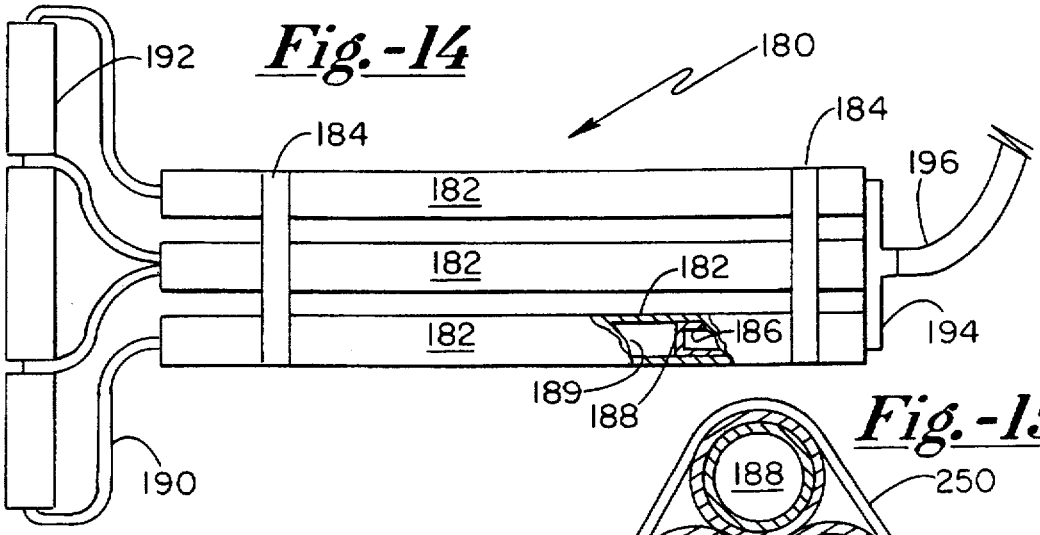
FIG. 14 shows a top view of an alternate embodiment of the present invention where paint is fed to the roller portions via paint tubes.

FIGS. 14–21 illustrate other roller embodiments. FIG. 14 shows a roller 180 having a set of three pressure-fed paint sticks or paint tubes 182 fixed in a planar arrangement via rigid belts 184. Each of the outer tubes 182 includes an inner tube 186 with an end 188 for feeding paint or other coating 189 toward feed tubes 190 and roller portions 192. Inner tubes 186 are pushed axially in the outer tubes 182 pneumatically through a manifold 194 communicating with an air source through a tube 196. Feed tubes 190 are rigid so as to provide a frame arrangement for the roller portions 192 as well as to feed coating fluid to the roller portions 192. At each of the distal ends 197 of the feed tubes 190 is affixed a swivel nozzle 198. Swivel nozzles 198 are affixed in and rotate with a plastic body 206 which forms an internal hopper 202 which extends for 360° about the plastic body 206. Bearings or bushings 204 fixed in a cylindrical opening 207 of plastic body provide support for the distal end portions 197 of the feed tubes 190. Nap 208 may include a porous cylindrical base which supports the nap 208 and permits fluid flow therethrough. Hopper 202 extends substantially to the ends of the roller portions 192 to wet the entire nap 208, as shown by the absence of phantom lines in FIG. 17.

Figure 18:
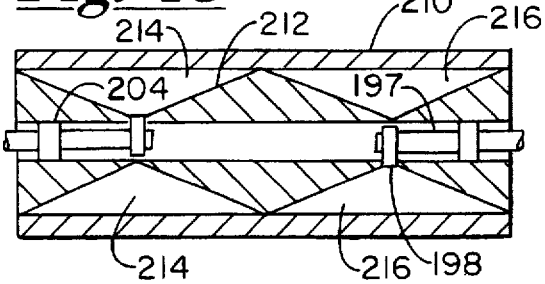
FIG. 18 shows a section view of another internal hopper arrangement where one roller portion may have two aligned hoppers, which may be used for spreading the same or different colors.
Figure 19:
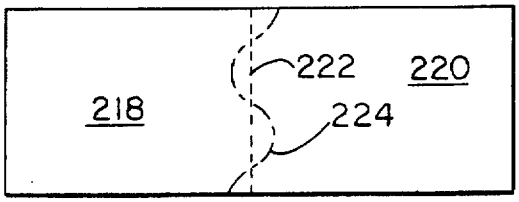
FIG. 19 shows an elevation view of the roller portion of FIG. 18.

Another roller portion embodiment for the roller 180 is shown in FIGS. 18 and 19. Here roller portion 210 includes a plastic body 212 forming two internal hoppers 214, 216, each of which may feed a coating having the same or different characteristics to a respective, different nap portion 218, 220. The plastic body 212 may form a linear junction between the hoppers 214 and 216, as shown by phantom line 222. Or the plastic body may form a nonlinear junction, such as a curvilinear junction 224 to provide a softer blend such as between two different colors.

Figure 20:
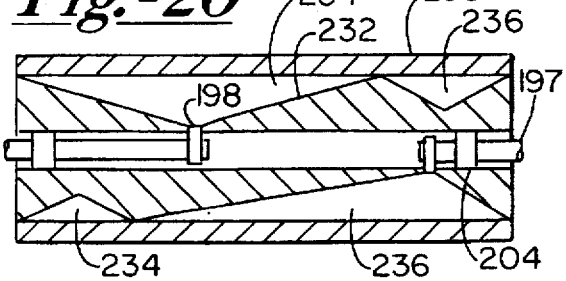
FIG. 20 shows a section view of another internal hopper arrangement where one roller portion includes two non-aligned hoppers, which may be used for spreading the same of different colors.
Figure 21:
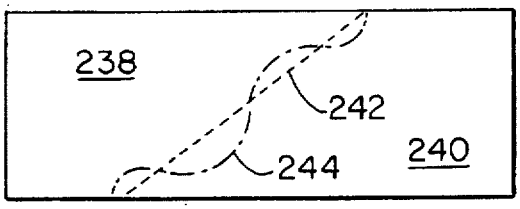
FIG. 21 shows an elevation view of the roller portion of FIG. 20.
Figure 22:
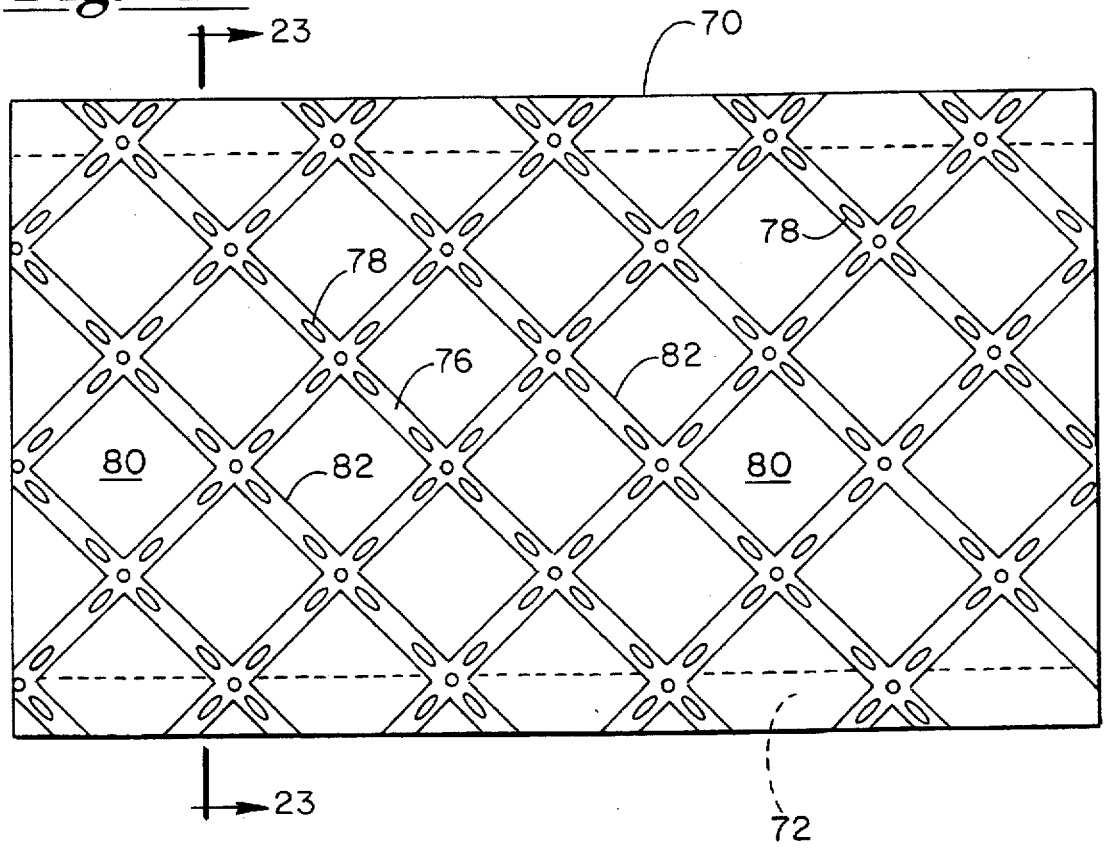
FIG. 22 shows a top view of a tray for the paint pan of FIG. 4, with the tray having a roughened surface for wiping excess paint off the roller of FIG. 1.
Figure 23:
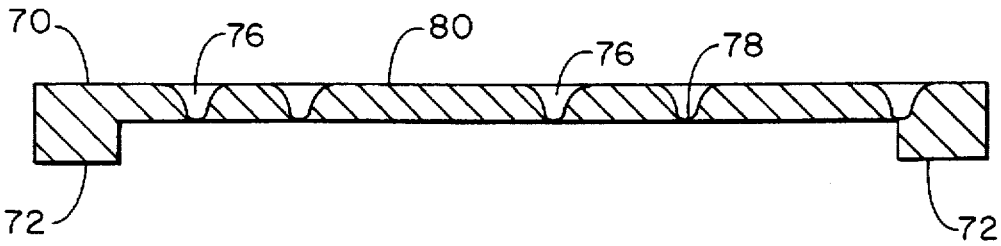
FIG. 23 shows a section view at lines 23—23 of FIG. 22.

Another roller portion embodiment for the roller 180 is shown in FIGS. 20 and 21. Here roller portion 230 includes a plastic body 232 forming two internal hoppers 234 and 236, each of which may feed a coating having the same or different characteristics to a respective, different nap portion 238, 240. Here the plastic body may form an angled, linear junction 242 or a nonlinear, curved junction 244 between the hoppers 234, 236.

It should be noted that internal hoppers, such as internal hoppers 202, 214, 216, 234, 236, may extend less than 360° about a roller portion. In other words, plastic bodies 206, 212, 232 may form a hopper extending from 5° to 355° about a roller portion and have a periphery of any shape, such as an irregular shape shown in FIGS. 10, 11, and 24–37.

Figure 15:
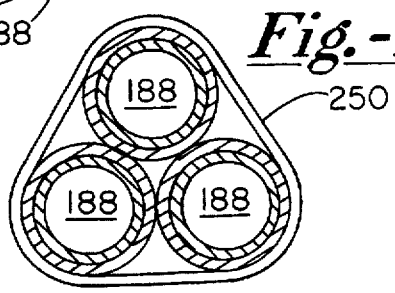
FIG. 15 shows a section view of an embodiment similar to FIG. 14.
Figure 16:
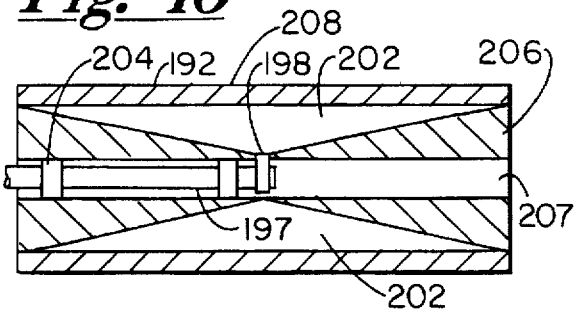
FIG. 16 shows a section view of the internal hopper of one roller portion of FIG. 14, which may be used for spreading one color.
Figure 17:
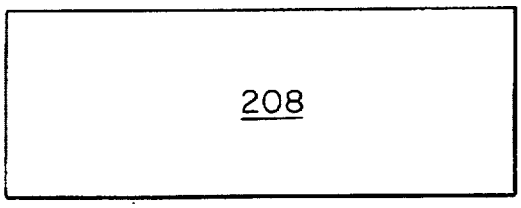
FIG. 17 shows an elevation view of the roller portion of FIG. 16.

It should be noted that FIG. 15 shows the tubes 182, 186 in a more compact form. Such tubes are held together with two triangular rigid belts 250 disposed in the same location as belts 184.

FIGS. 24–37 illustrate nap arrangements. In the FIGS. 24–37, respective reference numerals 260*a–n* indicate respective nap portions and respective reference numerals 270*a–n* indicate the spacings between the nap portions 260*a–n* or the base to which the nap, most preferably mohair, is glued or otherwise affixed. The nap portions 260*a–n* may be from about ⅛ inches to ¼ inches to ½ inches in height. All nap portions 260*a–n* have their peripheries spaced from each of the other nap portions 260*a–n*. The arrangement of the nap portions 260*a–n* may be in either the lateral or longitudinal direction of the roller portions 20. Each nap arrangement may be manufactured in flat form with a flexible base which is later affixed to a rigid cylindrical base such as base 44. Or each nap arrangement may be cut out of an already manufactured mohair cylindrical nap having a cylindrical base. Each nap arrangement may fit on and around a roller portion 20 which preferably is about four inches in lateral length and includes a base diameter of about one to two inches. It should further be noted that each nap arrangement is preferably paired with an identical nap arrangement. For example, the pattern shown in FIG. 24 may be the nap pattern for each of the roller portions of the bifurcated roller 10. Or similar nap patterns are placed on each of the roller portions. Or, if desired, the nap arrangements of FIGS. 1, 10, 11, and 24–37 may be mixed and matched with each other for placement on the roller portions of the bifurcated roller 10; for example, the nap arrangement of FIG. 36 may serve as one of the roller portions and the nap arrangement of FIG. 37 may serve as the other roller portion. Preferably, each of the nap arrangements spreads a paint of a different color characteristic.

Figure 24:
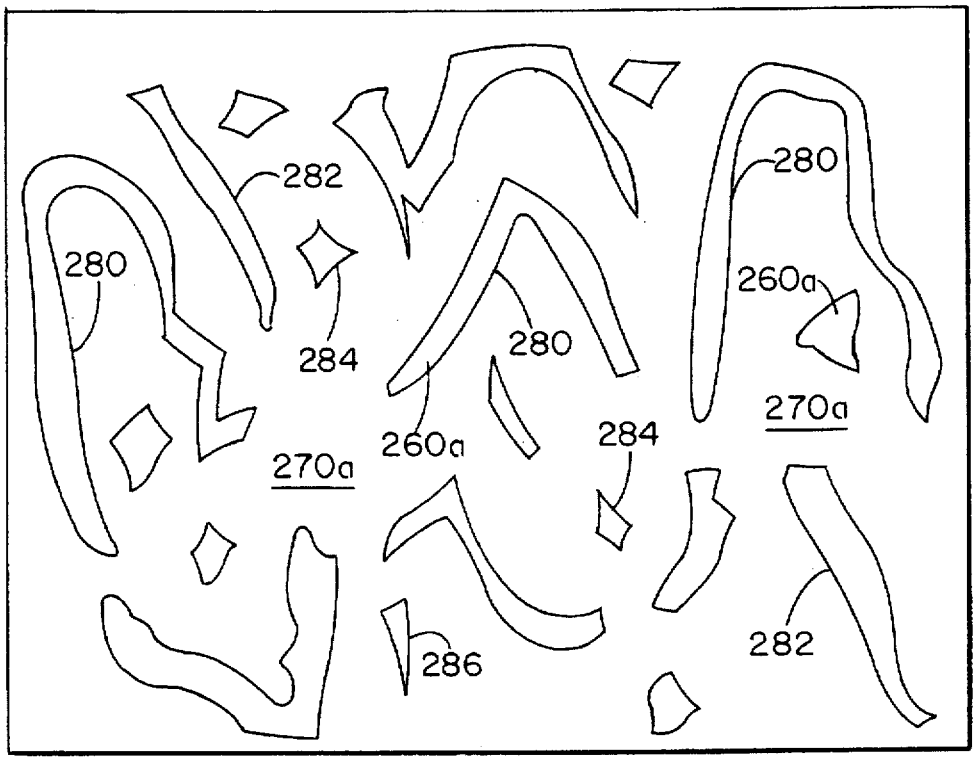
FIGS. 24–37 show irregular nap arrangements in dimensions close to actual size for being placed on the roller portions of the bifurcated roller; each nap arrangement is for one roller portion and an identical nap arrangement is placed on its adjacent but spaced apart roller.

FIG. 24 shows some nap portions 280 having irregular, general "U" or "V" shapes interdispersed with irregular, generally linear nap portions 282, irregular, generally diamond shaped nap portions 284, and irregular, generally triangular nap portions 286. The peripheries of the nap portions in FIG. 24 generally have sharp corners and peripheries.

Figure 25:
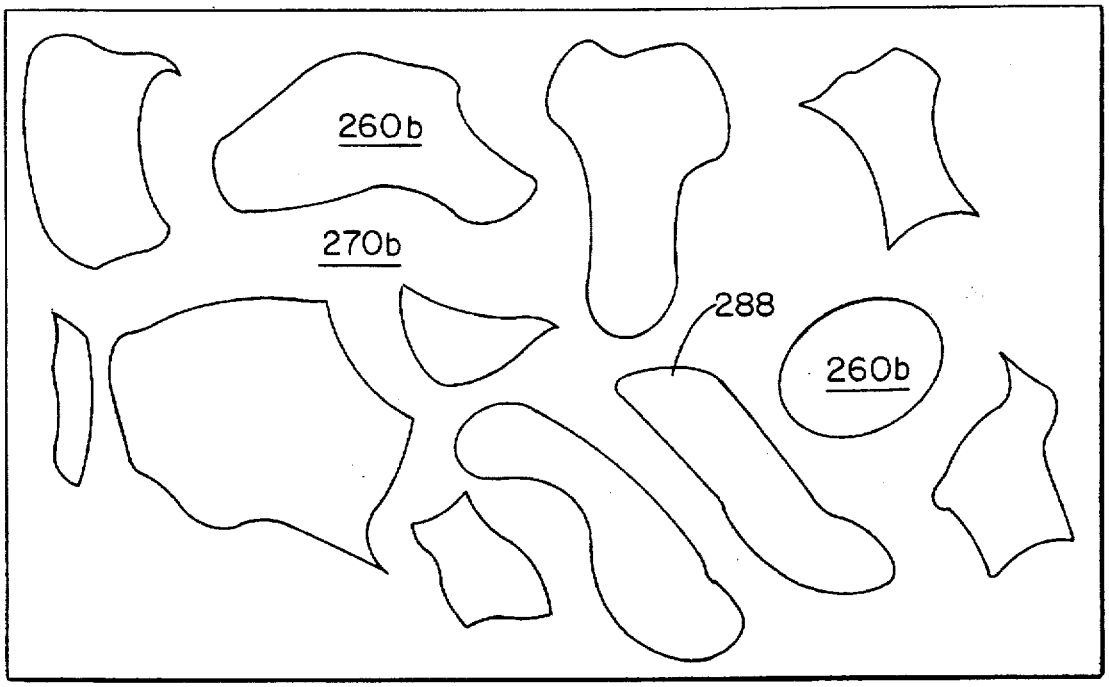

FIG. 25 shows a generally elephant foot or pond or lake pattern of nap portions 288 which generally have rounded peripheries.

Figure 26:
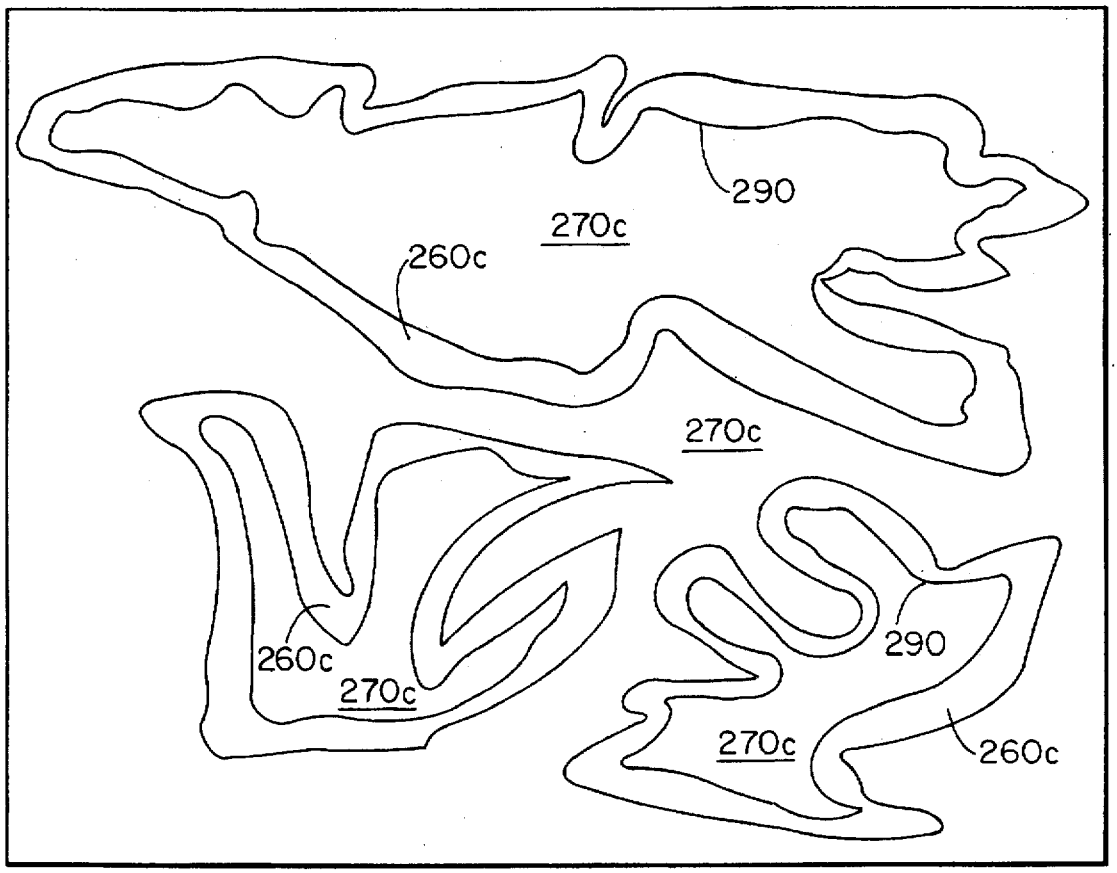

FIG. 26 shows generally worm-like, endless nap portions 290 which are generally curvilinear.

Figure 27:
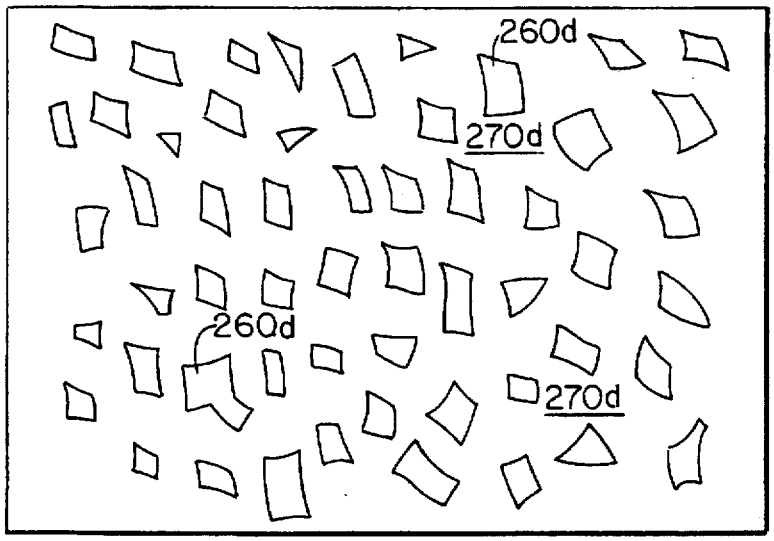

FIG. 27 shows generally diamond, squared, rectangular, trapezoidal, and triangular shaped nap portions. Such nap portions are irregularly shaped and spaced from each other.

Figure 28:
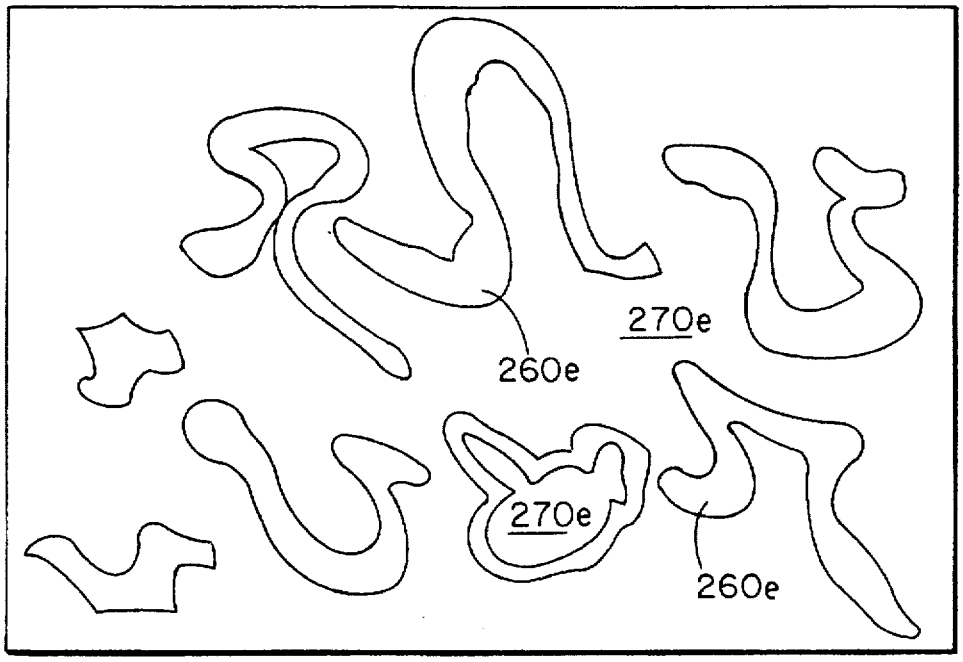

FIG. 28 shows nap portions which are irregular and generally formed in the shape of worms. Some nap portions have the irregular, general shape of a "U."

Figure 29:
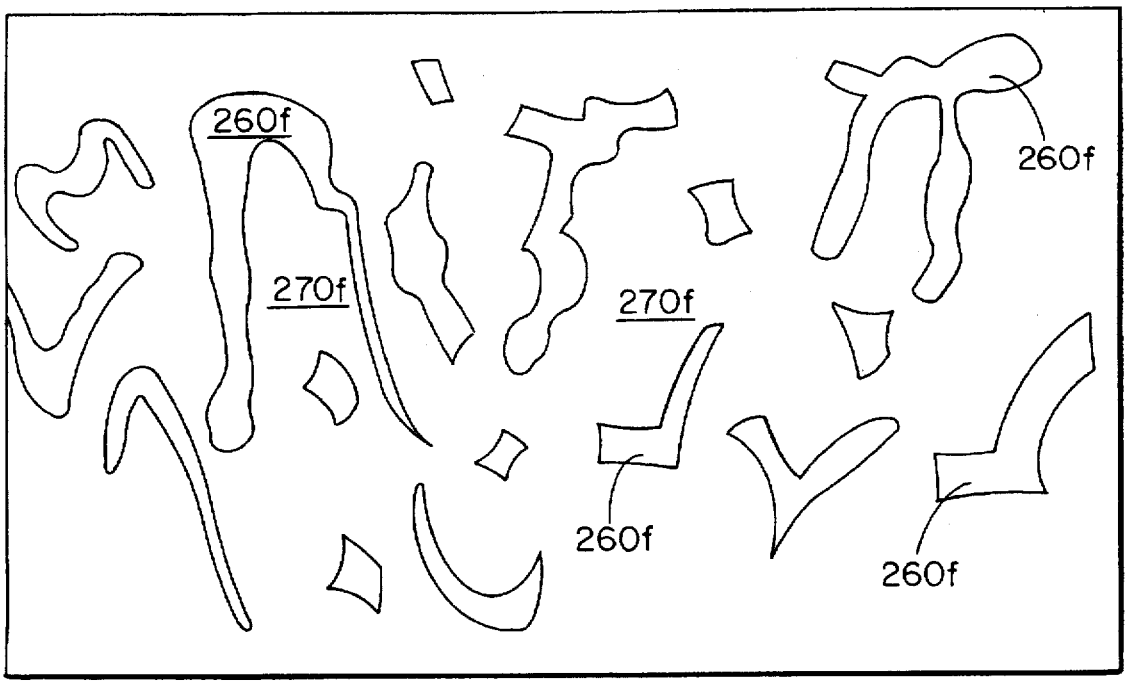

FIG. 29 shows a mix of irregular, elongated nap portions and irregular, block like nap portions.

Figure 30:
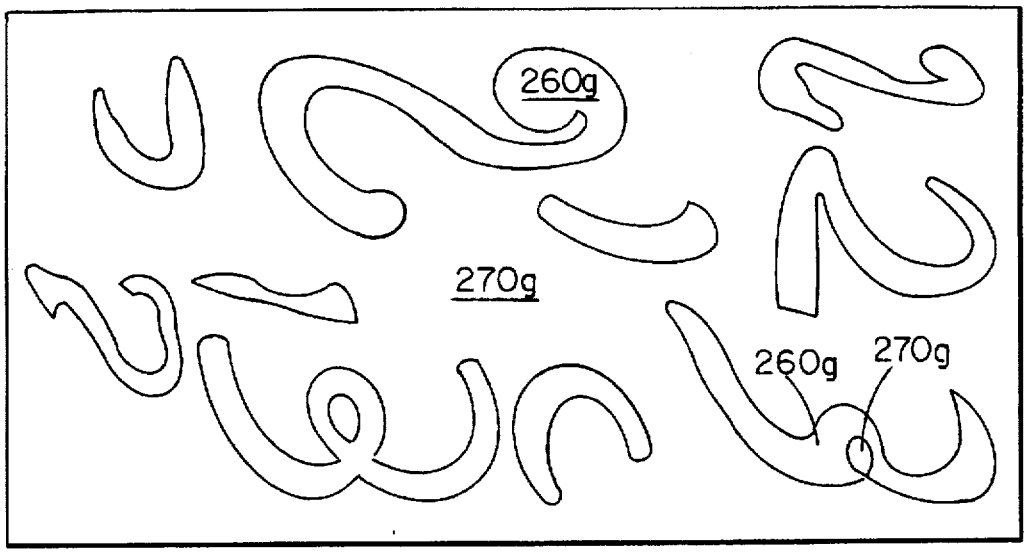

FIG. 30 shows nap portions shaped generally like the numbers "1", "2" and "3." Such nap portions are irregularly shaped.

Figure 31:
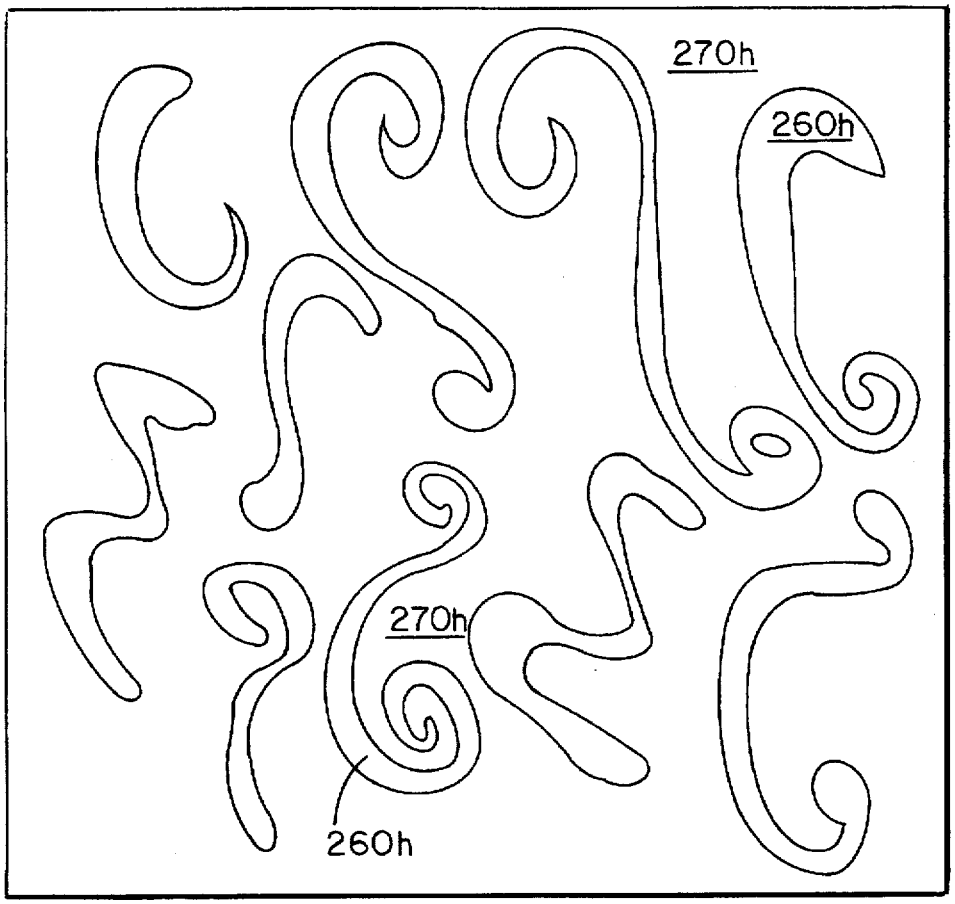

FIG. 31 shows nap portions shaped generally like wrought iron or musical clef symbols. Such nap portions are irregular and have curled ends.

Figure 32:
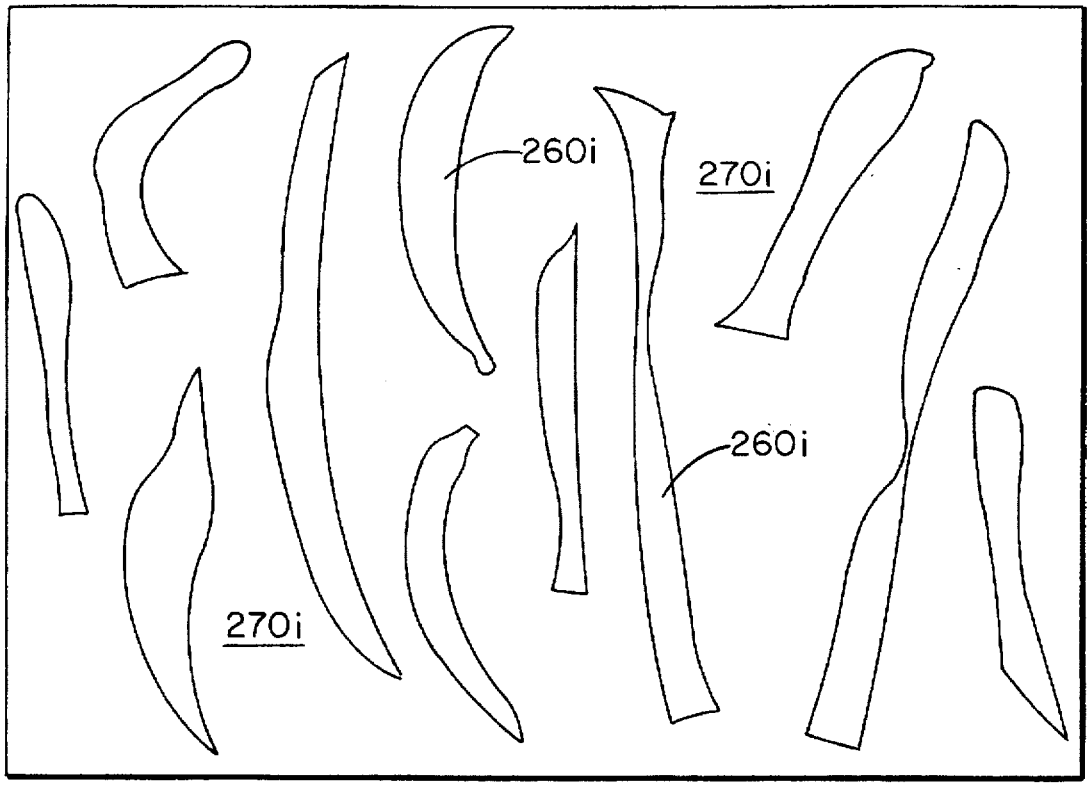

FIG. 32 shows irregularly shaped linear nap portions.

Figure 33:
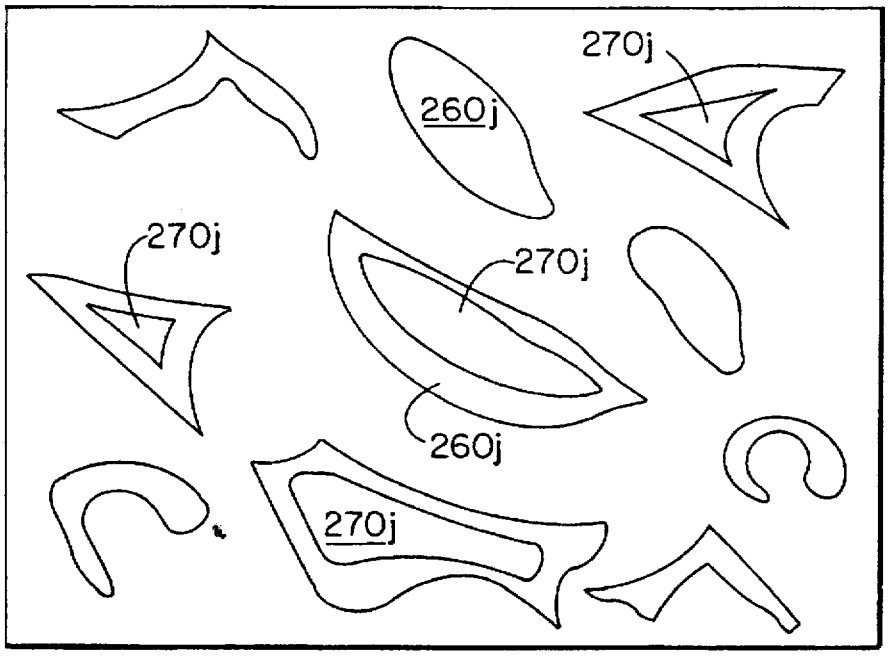

FIG. 33 shows endless nap portions in the form of lips or smiles, block-like nap portions having curved peripheries, and nonlinear nap portion segments. Such nap portions are irregular.

Figure 34:
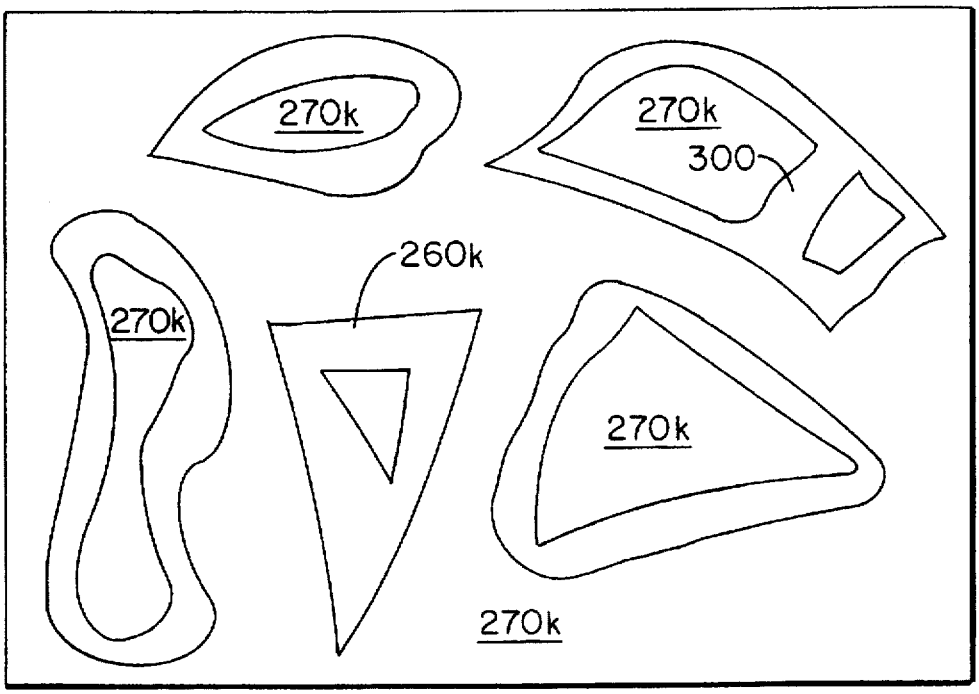

FIG. 34 shows irregular, endless nap portions. One nap portion includes a bridge 300.

Figure 35:
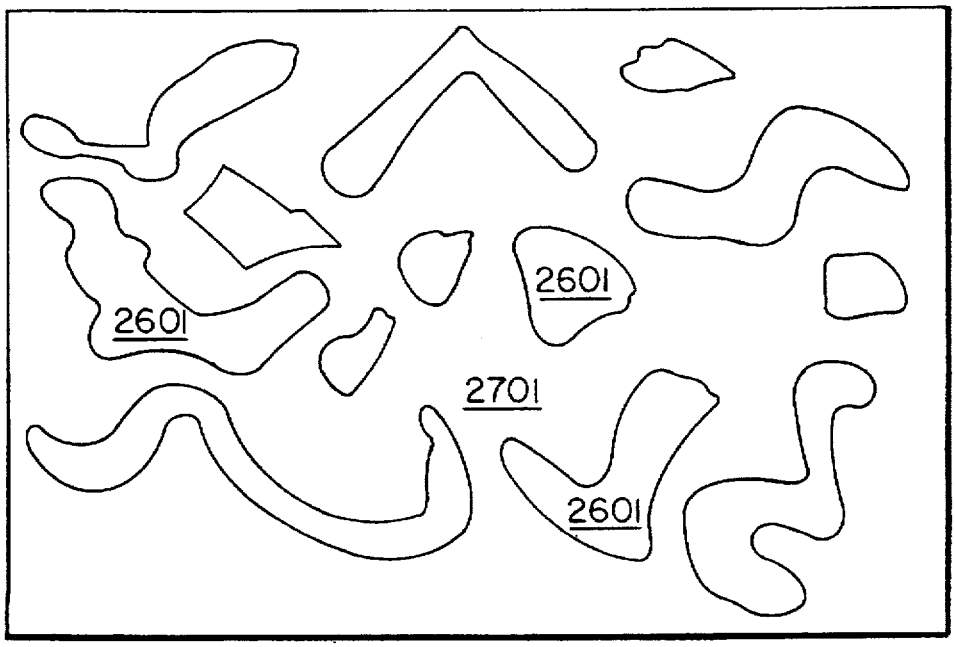

FIG. 35 shows irregular nap portions generally in the form of blocks and worms.

Figure 36:
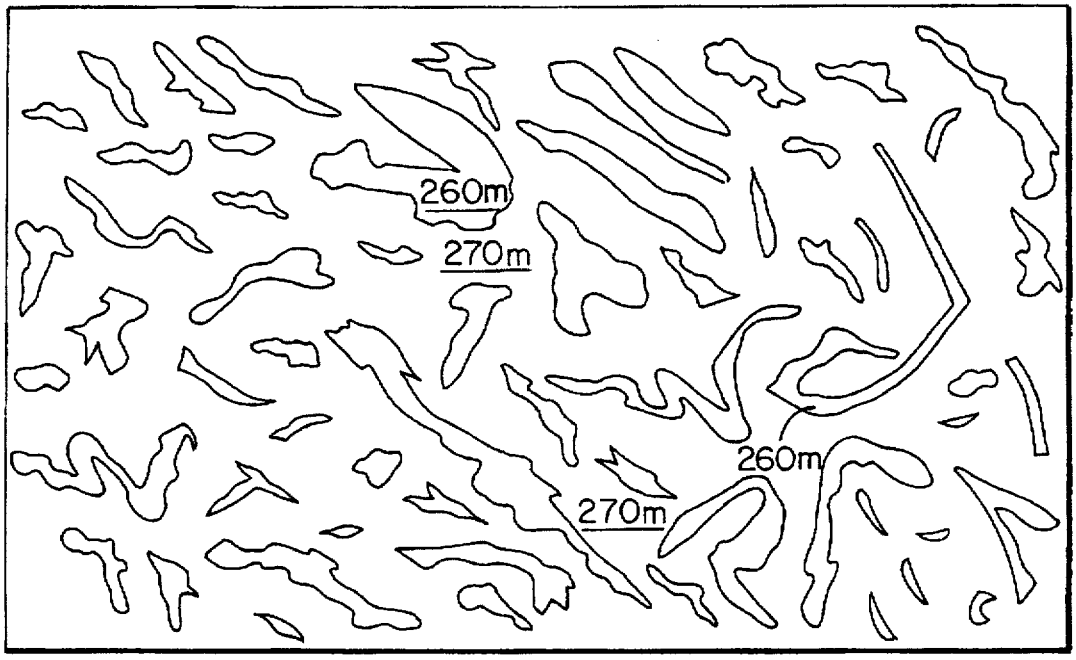

FIG. 36 shows nap portions which when rolled may come the closest to duplicate the time consuming and expensive rag rolling painting method. The nap portions here reflect the creases formed in a rolled rag. The arrangement generally includes elongate nap portion segments of a relatively great size and elongate nap portion segments of a relatively small size. Some of the peripheries are smooth; most of the peripheries are highly irregular with sharp turns.

Figure 37:
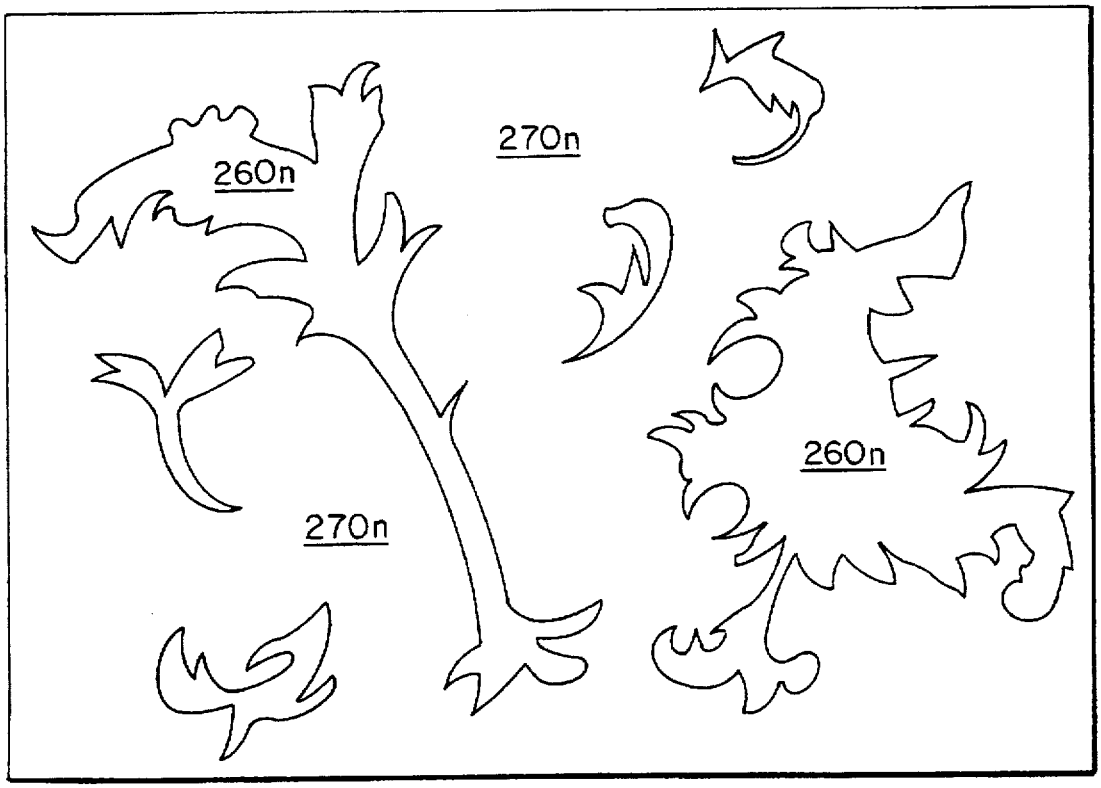

FIG. 37 shows a general leaf or leaf-like pattern of irregular nap portions.

It should be noted that a random method of painting, such as shown in FIG. 6, is preferably used for the nap patterns of FIGS. 10, 11, and 24–37. However, if desired, the bifurcated roller 10 may be rolled in parallel fashion without the roller portions overlapping.

It should be noted that the step of equalizing the paints or coatings having different characteristics means adding one or more additives to one or more of the paints or coatings such as to make the paints or coatings compatible with each other, such as to make the viscosity or surface tension of the paints substantially the same, or such as to affect another feature of one or more of the paints so as to facilitate overlapping and intermixing. Without an equalizing step, the paints may not intermix, which is preferred. The equalizing step is preferred because the paints are wet at the same time on the substrate. The additives include, but are not limited to, one or more of the following: thickening agents, thinning agents including solvents, antisettling agents, antiskinning agents, antifloating agents, driers to speed polymerization or oxidation or both such as the liquid or metallic soaps of cobalt, lead, manganese, or calcium, loss-of-dry inhibitors, freeze-thaw stabilizers, anti-foaming agents, preservatives, bodying and puffing agents (including thickening agents) which increase viscosity for proper application and drying, leveling agents to reduce brush or roller marks, antisagging agents to prevent curtains, runs or sags in wet paint, glossing and flatting agents to change the sheen of the paint, and coalescing agents to soften latex particles to help them flow into a continuous film.

Preferably, "characteristic" means a characteristic of the coating such as its pigment, color, extender, metallic extender, metal primer, extenders for flexibility or durability, vehicle, film-former such as an oil, resin, polymer, plasticizer, thinner, solvent, diluent, additive such as wetting agent, thickener, matting agent, accelerator, inhibitor, or dye, resin, natural resin, synthetic resin, any of the above mentioned additives for the equalizing step, adhesive, catalyst, or other chemical or agent serving a significant purpose in the coating or paint and whose generally simultaneous combination with another characteristic from an adjacent and spaced apart roller portion is desirable for the end product.

Most preferably, it should be noted that "characteristic" means a "color characteristic." A color characteristic for the purposes of the present application is defined as one of the following: color, hue, intermediate color, midtone, neutral, pastel, primary color, saturation, secondary color, shade, tertiary color, tint, tone, type of pearlescent paint, or type of micaceous material or other agent in the paint to achieve the pearlescent effect. For example, a first hue is a color characteristic different from a second hue.

It should be noted that the preferred features of the present invention may be mixed and matched to produce a certain combination or withheld to produce another combination. These preferred features, which may be present or absent in a combination, include but are not limited to the following: the bifurcated roller having spaced apart and axially aligned roller portions, a new, fleeced nap, a nap arrangement as shown in FIGS. 10, 11, and 24–37, a color characteristic, a matted, flagged, or intertwined nap for throwing paint which may be in the form of a cylindrical nap or a nap arrangement as in FIGS. 10, 11, and 24–37, a layer of textured paint, a layer of water-based polyurethane paint, a sandwich of water-based polyurethane/textured latex paint/water-based polyurethane, an axial adjustment of the spacing between the roller portions, the height of the nap hairs from the base of the nap, the sheeting applied to the textured coat, the sheeting applied to the two-color coat, the strings of paint, the spatters, a bifurcated roller having a roller portions with axes offset from one another, base coat, color of base coat, dividing wall in paint pan to separate paint for each roller portion, and pressure-fed rollers having internal hoppers.

It should be noted that the present invention is directed to the art of wall or floor coverings and coatings. Substrates include but are not limited to interior and exterior surfaces such as acoustical, fiberboard, drywall, plaster, masonry, concrete, concrete block, unglazed brick, cement brick, concrete or masonry floors, aluminum, galvanized steel, structural steel and ornamental iron, wood walls, ceilings, trim cabinet works, hardboard, painted wood floors, stained wood floors, asbestos siding, transite, shingle, stucco, common brick, concrete walls, concrete and cinder block, concrete floors, patios, steps, platforms, ornamental steel, prefinished metal siding and panels, wood floors and platforms, plywood, shingles, shakes, rough-sawn lumber, siding, trim, doors, hardboard, and oriented strand board.

Coatings and paints include those mentioned above and further include but are not limited to acrylics, alkyds, chlorinated rubber, coal tar epoxies, epoxies, epoxy-esters, neoprene and hypalon, phenolics, phenolics catalyzed, polyesters, polyurethanes, silicones, vinyls, water-based coatings, and zinc-rich coatings.

The roller nap or roller cover, such as nap 20, or nap portions such as indicated in FIGS. 10, 11, and 24–37 may be formed of synthetic or natural fibers. Synthetic fibers include open or closed foam. Natural fibers include mohair or wool. The foam may be a urethane foam. Or the nap may be formed of a rubber or plastic or wood with the nap pattern integrally formed therein.

It should be noted that the present method produces the illusion or "faux air" that a substrate has been sponge painted or rag roll painted while in fact the substrate has been quickly painted with the present bifurcated roller. However, unlike sponge painting or rag rolling, which delivers a thin coat, and unlike the thin coats of ink on wallpaper, the present method delivers a coat of paint which is as thick as that applied by a conventional roller.

A painter using the present bifurcated roller may paint a bedroom sized room in an hour. In contrast, a painter using a sponge or rag may take one to three days to paint such a room. Further, rag rollers produce a great amount of waste; once the rag being rolled is saturated, a new rag is used. For one such bedroom sized room, a pail or even a bushel or rags may be used.

It should be noted that the naps having flagged or intertwined hairs may be produced by taking a fleece nap, saturating the nap with paint, hand manipulating or pinching the nap into peaks and valleys, lightly washing off the nap with water, and then permitting the nap to dry. Or a fully matted nap may be prepared simply by using a nap over and over and over again with little washing of the nap.

One type of polyethylene sheeting that may be used for producing the variegations in the textured coat and two-characteristic coat is Visquine®. It should be further noted that the variegations may be referred to as a marbling effect.

It can be appreciated that when the sheeting is pulled off the two color coat, one or two colors are pulled off at random locations because two or more colors are wet. The viscosity of the two or more colors determines how much surface tension is present, and how much coating is pulled off with the sheeting. The greater the surface tension, the less amount of coating comes off.

It can be appreciated that an infinite number of designs can be produced with the present method. The two colors are variable, and the color of the textured or base coat may be varied; such alone may produce an infinite number of effects. By adding another variable, such as the patterns of the nap portions of FIGS. 10, 11, and 24–37, the number of effects increases ever more.

It can be appreciated that the tube 186 or paint in tube 182 of pressure-fed roller 180 may, instead of being operated pneumatically, be pushed by hand, by a mechanism similar to a caulking gun, by an airless hydraulic mechanism, by a pressure paint pot, or by some other pump or compressing mechanism. Further, with such a tool 180, the rate at which paint is fed to the internal hoppers may be varied. For example, white paint may be fed at a faster rate than red paint in another tube. Such rates may be controlled by valves in the manifold.

It should be noted that the water-based polyurethane used herein may be cross-linked so as to be more durable.

It should be noted that handling or rolling of the bifurcated roller 10 produces varying effects. For example, more rolling produces more blending of colors and a greater percentage of the textured or base coat may be covered. More rolling generally produces a more conservative effect.

It should be noted that the bifurcated roller 10 may be of a smaller or miniature size to fit hard-to-reach areas. Conversely, the bifurcated roller 10 may be rather large, such as the roller used to paint the sides of buildings; in such a case it may be possible to produce random patterns which have different illusions from different distances. The scale of the patterns may be varied.

It should further be noted that when using a foam nap, extra defoamer such as a water based silicone may be added so as to level out the paint being applied by the foam nap.

It can be appreciated that when one nap portion pattern, such as that in FIG. 24, is on both roller portions, a pattern may be somewhat repeated. A "consistently random" look may be achieved.

Figure 38:
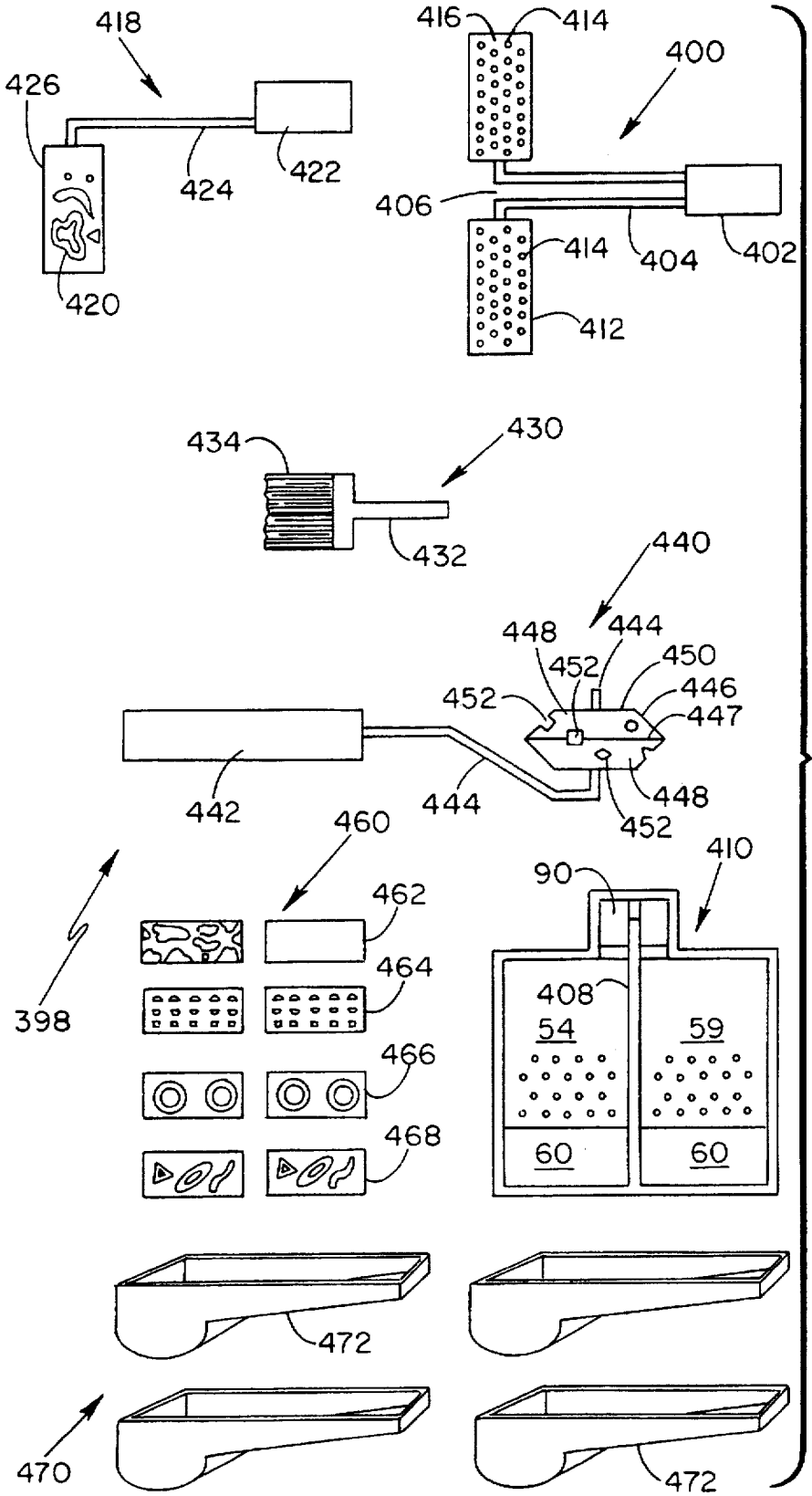
FIG. 38 shows elevation and perspective views of elements of a kit for the present method.

One preferred kit combination 398, as shown in FIG. 38, includes a bifurcated roller 400 with a handle 402, a frame arrangement 404 having an open-ended slot 406 with a width greater than the thickness of dividing wall 408 of pan 410, which is similar to pan 50. The roller 400 further includes roller portions 412 rotatably mounted on the frame arrangement 404. Each of the designer roller covers 412 includes a pin type pattern which may provide a suede look when rolled. The pin type pattern includes raised nap portions 414 in the form of disks extending for 360° about each of the roller portions as each of the other nap patterns in FIGS. 10, 11 and 24–37. Reference numeral 416 indicates the nonspreading base of the roller portion. The kit 398 further includes a roller 418 for highlighting which includes a nap portion pattern or designer roller cover 420 as shown in FIG. 38 or as shown in FIGS. 10, 11, and 24–37. The roller 418 includes a handle 422, a frame 424 affixed to the handle 422, and a roller portion 426 rotatably mounted on the distal end of the frame 424. The kit 398 further includes brush 430 with a handle 432 and bristles 434 for interacting with receptacles 90. The kit 398 further includes a corner roller 440 for rolling corners or intersections between walls. The roller 440 includes a handle 442, a frame 444, and a generally disk like roller 446. The edge 447 is formed by two beveled faces 448 extending at ninety degrees relative to each other and at forty-five degrees relative to faces 450 so as to roll in corners. Each of the faces 448 have chunks of foam removed so as to leave crevices or openings 452 in the roller 446. The crevices 452 carry the randomness effect of the paint into the corner of the room where the roller 10 may not reach. The kit 398 further includes a set 460 of cylindrical roller covers. The set 460 includes a pair of roller covers 462 with one roller cover being a cylindrical conventional nap portion as shown in FIG. 1 and with the other roller cover having a pattern in the nature of the pattern shown in FIG. 10, a pair of roller covers 464 having a pattern of split disks, a pair of roller covers 466 having a pattern of circles, and a pair of roller covers 468 having triangle, oval, and worm pattern. The kit 398 further includes the pan 410, and a set 470 of four liners 472. Each liner 472 fits into one of the receptacle portions 54; hence each liner 472 holds only one color. Each liner 472 is integrally molded and conforms generally if not substantially perfectly to the inner contour of one half of pan 410 or pan 50.

Figure 39:
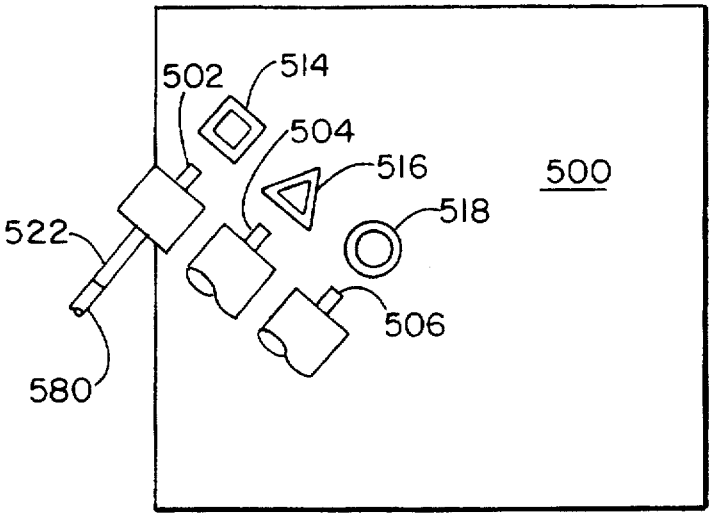
FIG. 39 shows a schematic view of a three nozzle arrangement for simultaneously painting three colors.
Figure 40:
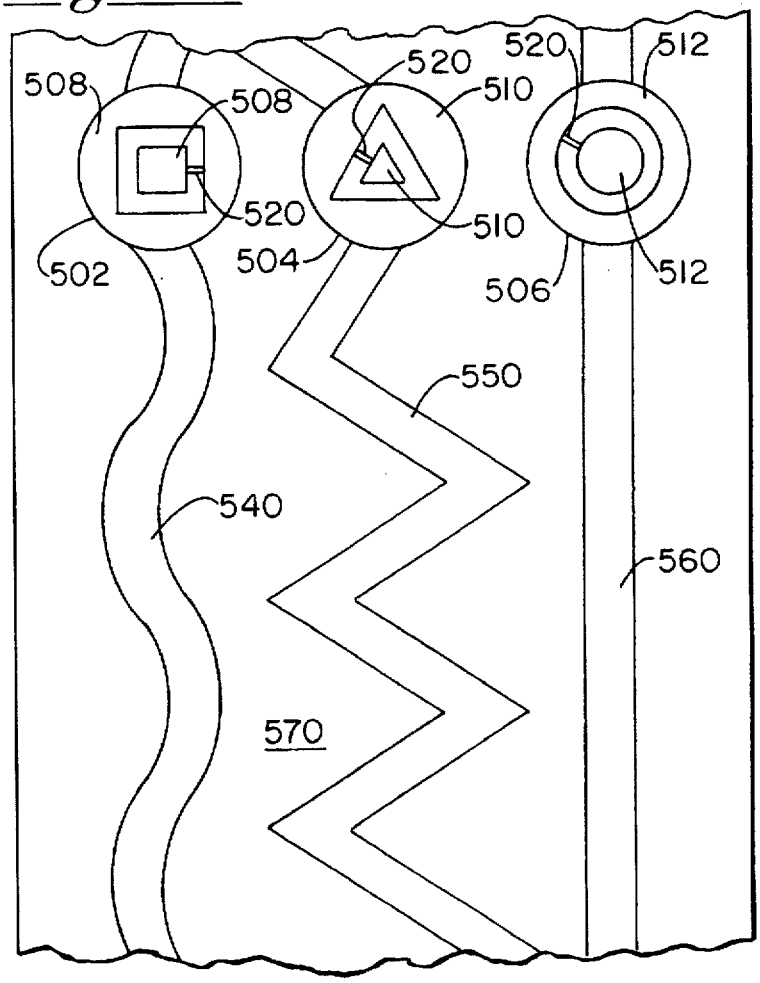
FIG. 40 shows a schematic view of the nozzles of FIG. 39 in tracks, and further shows stencils set in the nozzles for delivering pulses of paint.
Figure 41:
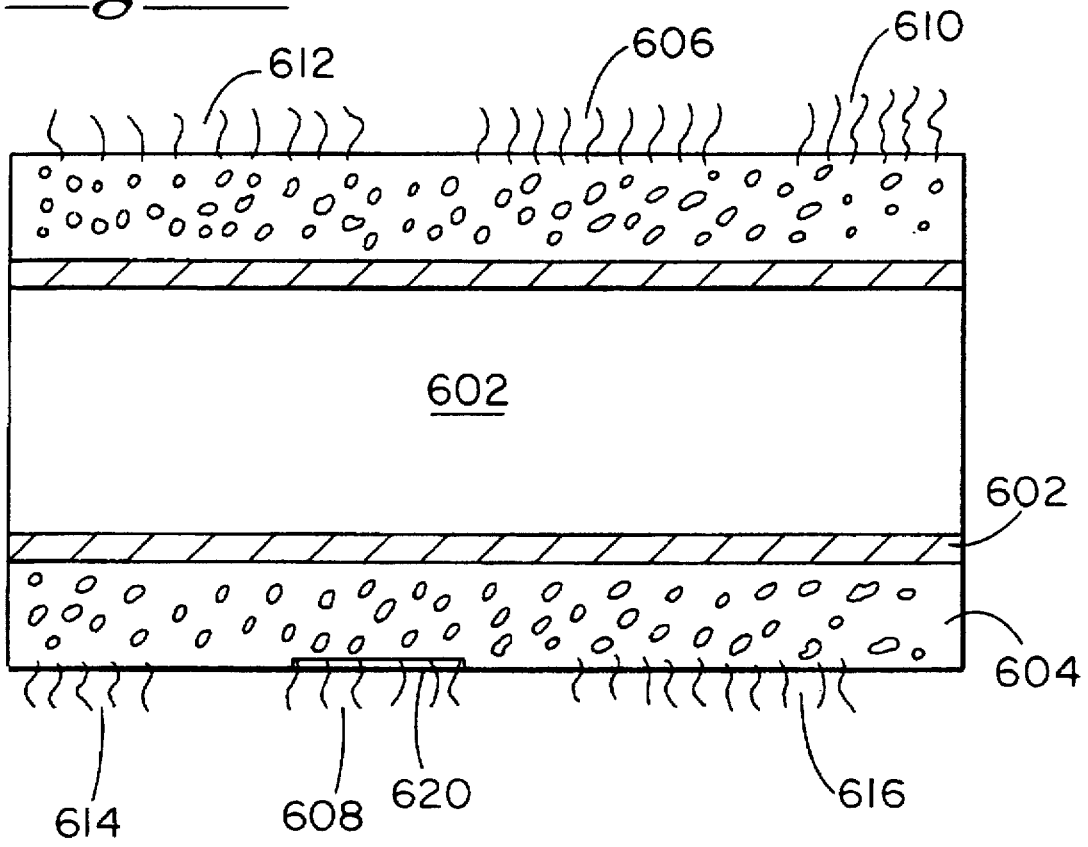
FIG. 41 shows a section view of a roller portion for rolling a pattern on masonry.

As shown schematically in FIGS. 39 and 40, two or more colors or characteristics may be applied to a substrate 500 simultaneously with a spray gun having three nozzles 502, 504, 506 which are fed paint independently of each of the other nozzles. Each of the nozzles 502, 504, 506 has a respective stencil 508, 510, 512 fixed therein to deliver paint in the form of a square 514, triangle 516, or circle 518 to the substrate 500. A middle portion of each stencil may be supported by an integral support 520. Each of the nozzles 502, 504, 506 may deliver the paint in a pulsating manner while a rigid portion 522 of each of the nozzles is moved in a respective track 540, 550, 560 formed in a plate 570. A less rigid portion 580 of each of the nozzles, such as a paint delivery hose, may extend to conventional paint pumping equipment. Such pumping equipment may be that which delivers strings or spatters to walls. It should be noted that before the pattern formed on the substrate 500 by the nozzles and tracks dries, the pattern may be wiped with brushes manually or automatically or may have impressed upon it sheeting as described above. The polyethylene sheeting may be applied manually or automatically, pressed manually or automatically upon the substrate, and removed before the paint is dry to form variegations.

It can be appreciated that the designer roller covers or nap arrangements may be customized so as to reflect the pattern of a curtain or carpet that one wishes to duplicate. For example, the pattern found in the carpet is reproduced for both roller portions, and the color or colors of the carpet are spread separately and simultaneously by the spaced apart but adjacent roller portions.

FIG. 42 shows in section a roller cover 600 for rolling patterns on stucco or other masonry. The roller cover 600 includes a cylindrical base 602, a closed or open celled foam 604 in cylindrical form affixed to the base 602, and nap portions 606, 608, 610, 612, 614, and 616 fixed to the foam 604. The hairs of the nap portions 606–616 may be individually set in the foam 604 or each of the pattern forming nap portions may include a base 620 which is affixed to the foam and in which each of the hairs is set. The foam conforms to the relative rough and deep topography of masonry, such as stucco, and delivers paint into valleys formed in the masonry. The hairs of the cover 600 may be relatively long if desired.

It should be noted that the base color may be one of the colors applied by one of the roller portions 20 or by any of the designer covers of FIGS. 10, 11, and FIGS. 24–38.

It should be noted that each of the nap arrangements or designer covers of FIGS. 10, 11, and FIGS. 24–38 may be referred to as stencil covers.

It should be noted that instead of applying a sheeting to add a variegation effect, or prior to or after such a sheeting step, the two color or two characteristic coat may be dry brushed such as with brush 430. Such may tone down the end effect.

It should be noted that "faux" finishes are not durable. Neither is wallpaper durable. With the method of the present invention, a "faux" look can be provided, and such a "faux" look is durable, especially when cross-linked polyurethane paint is used. The present method provides a "faux" look which can be washed, driven upon by cars, scratched and repaired. Such is not possible with wallpaper or the delicate "faux" works provided by sponge painting or rag rolling.

It should be noted, for the equalizing step, that colorants or earthen pigments may affect the surface tension of the paint. Thickeners may then be added to adjust the surface tension.

It can further be appreciated that stencils may be used with the bifurcated roller 10. Such stencils may be formed of the thin polyethylene sheeting, and the bifurcated roller 10 may be rolled over such a stencil and over the gaps formed in the stencil.

The following aesthetically pleasing samples were obtained with the present bifurcated roller. The examples included the following features: a plywood panel as a substrate, a water-based polyurethane base coat which was applied over 100% of the face of the substrate, and a water-based polyurethane base coat for each of the two colors in the two color coat. Relatively less durable latex paint was used for the intermediate textured coat. Mixed in with the latex paint for the intermediate coat were one or more of the following fillers: calcium carbonate, clay, aluminum hydrate. The rollers were spread apart by about three inches, unless otherwise noted.

EXAMPLE 1

Base coat color: Off-white

Intermediate textured coat: None

Sheeting applied over intermediate textured coat: N/A

Type of bifurcated roller: Fleece, matted to throw paint

Length of naps on bifurcated roller: ⅜ inches when new

Two color coat: Williamsburg blue and celery green

Percent of two color coat coverage over base coat: 40%

Surface tension of two color coat: Equalized and raised to 110 Krebs

Sheeting applied over two color coat: Yes

Optional steps: None

Overall effect: Sponge effect

EXAMPLE 2

Base coat color: Celery green

Intermediate textured coat: None

Sheeting applied over intermediate texture coat: N/A

Type of bifurcated roller: Fleece, matted to throw paint

Length of naps on bifurcated roller: 1¼ inches when new, about ¾ inches when matted Two color coat: Off-white, saturated celery green Percent of two color coat coverage over base coat: 90%

Surface tension of two color coat: Equalized and raised to 150 Krebs

Sheeting applied over two color coat: None

Optional steps: None

Overall effect: Rag effect

EXAMPLE 3

Base coat color: Off-white

Intermediate textured coat: Off-white

Sheeting applied over intermediate texture coat: Yes

Type of bifurcated roller: Fleece, new

Length of naps on bifurcated roller: ⅜ inches

Two color coat: Tan, saturated (30%) tan

Percent of two color coat coverage over base coat: 80%

Surface tension of two color coat: Equalized

Sheeting applied over two color coat: Yes

Optional steps: None

Overall effect: Variegated, leather look

EXAMPLE 4

Base coat color: Black

Intermediate textured coat: None

Sheeting applied over intermediate texture coat: N/A

Type of bifurcated roller: Fleece, new

Length of naps on bifurcated roller: ⅜ inches

Two color coat: Gold pearl glee, white pearl glaze

Percent of two color coat coverage over base coat: 40%

Surface tension of two color coat: Equalized

Sheeting applied over two color coat: Yes, removed to take off about 50% of two color coat Optional steps: None Overall effect: Variegated, marble look

EXAMPLE 5

Base coat color: black

Intermediate textured coat: None

Sheeting applied over intermediate texture coat: N/A

Type of bifurcated roller: Fleece, new

Length of naps on bifurcated roller: ⅜ inches

Two color coat: Green pearl glaze, red pearl glaze

Percent of two color coat coverage over base coat: 60%

Surface tension of two color coat: Equalized

Sheeting applied over two color coat: Yes, removed about 50% of two-coat

Optional steps: Orange pearl glaze highlighting with conventional roller after two-color coat applied, prior to application of sheeting.

Overall effect: Variegated pearlescent

EXAMPLE 6

Base coat color: Blue

Intermediate textured coat: None

Sheeting applied over intermediate texture coat: N/A

Type of bifurcated roller: Fleece, matted

Length of naps on bifurcated roller: ⅜ inches when new

Two color coat: Williamsburg blue, off-white

Percent of two color coat coverage over base coat: 100%

Surface tension of two color coat: Equalized

Sheeting applied over two color coat: Yes

Optional steps: None.

Overall effect: Marble, cloud effect.

EXAMPLE 7

Base coat color: Tan

Intermediate textured coat: Off-white

Sheeting applied over intermediate texture coat: Yes

Type of bifurcated roller: Fleece, new

Length of naps on bifurcated roller: ⅜ inches

Two color coat: Tan, gray

Percent of two color coat coverage over base coat: 100%

Surface tension of two color coat: Equalized

Sheeting applied over two color coat: No

Optional steps: None

Overall effect: Variegated, textured

EXAMPLE 8

Base coat color: Green

Intermediate textured coat: None

Sheeting applied over intermediate texture coat: N/A

Type of bifurcated roller: Irregular pattern, foam, used (less absorbent)

Length of naps on bifurcated roller: ¼ inches

Two color coat: Cream, green

Percent of two color coat coverage over base coat: 30%

Surface tension of two color coat: Equalized

Sheeting applied over two color coat: None

Optional steps: Red applied as highlighting with irregular patterned roller

Overall effect: Irregular pattern

EXAMPLE 9

Base coat color: Off-white

Intermediate textured coat: Off-white

Sheeting applied over intermediate texture coat: Yes

Type of bifurcated roller: Fleece, matted

Length of naps on bifurcated roller: ⅜ inches

Two color coat: Tan, saturated tan (50%)

Percent of two color coat coverage over base coat: 100%

Surface tension of two color coat: Equalized and raised to 140 Krebs

Sheeting applied over two color coat: Yes

Optional steps: None

Overall effect: Variegated, rag, leather effect

EXAMPLE 10

Base coat color: Off-white

Intermediate textured coat: None

Sheeting applied over intermediate texture coat: N/A

Type of bifurcated roller: Mohair, elephant foot random pattern

Length of naps on bifurcated roller: ¼ inches

Two color coat: Tan, saturated tan (50%)

Percent of two color coat coverage over base coat: 100%

Surface tension of two color coat: Equalized and raised to 120 Krebs

Sheeting applied over two color coat: Yes

Optional steps: None

Overall effect: Ice-cube, suede look

EXAMPLE 11

Base coat color: Off-white

Intermediate textured coat: None

Sheeting applied over intermediate texture coat: N/A

Type of bifurcated roller: Foam pad having diamond shapes, spaced irregularly, with rollers separated by four inches Length of naps on bifurcated roller: ¼ inches Two color coat: Off-white, Bonnie blue Percent of two color coat coverage over base coat: 100%

Surface tension of two color coat: Equalized

Sheeting applied over two color coat: Yes

Optional steps: None

Overall effect: Cloud, diamond look

EXAMPLE 12

Base coat color: Off-white

Intermediate textured coat: Off-white

Sheeting applied over intermediate texture coat: 100%

Type of bifurcated roller: Strips of foam laid parallel to axis of roller, irregularly spaced Length of naps on bifurcated roller: ¼ inches Two color coat: Gold, gray Percent of two color coat coverage over base coat: 30%

Surface tension of two color coat: Equalized

Sheeting applied over two color coat: Yes.

Optional steps: None

Overall effect: Leaf effect

EXAMPLE 13

Base coat color: Blue

Intermediate textured coat: None

Sheeting applied over intermediate texture coat: N/A

Type of bifurcated roller: Fleece, matted; roller portions spread by five inches Length of naps on bifurcated roller: 1¼ inches when new, ¾ inches when matted Two color coat: Pink, green Percent of two color coat coverage over base coat: 80%

Surface tension of two color coat: Equalized

Sheeting applied over two color coat: None

Optional steps: Red spatter applied after two-color coat applied, and prior to application of sheeting Overall effect: Sponge effect

EXAMPLE 14

Base coat color: Off-white

Intermediate textured coat: Mild texture

Sheeting applied over intermediate texture coat: Yes

Type of bifurcated roller: Fleece, new

Length of naps on bifurcated roller: 1¼ inches

Two color coat: Off-white, blue

Percent of two color coat coverage over base coat: 100%

Surface tension of two color coat: Equalized

Sheeting applied over two color coat: None

Optional steps: None

Overall effect: Cloud effect

EXAMPLE 15

Base coat color: Off-white

Intermediate textured coat: Off-white

Sheeting applied over intermediate texture coat: Yes

Type of bifurcated roller: Foam with two inch long scores cut therein

Length of naps on bifurcated roller: ¼ inches

Two color coat: Off-white, blue-gray

Percent of two color coat coverage over base coat: 100%

Surface tension of two color coat: Equalized

Sheeting applied over two color coat: None

Optional steps: None

Overall effect: Textured cloud effect

EXAMPLE 16

Base coat color: Black

Intermediate textured coat: None

Sheeting applied over intermediate texture coat: N/A

Type of bifurcated roller: Fleece, new

Length of naps on bifurcated roller: ⅜ inches

Two color coat: Green pearl glaze, rust pearl glaze

Percent of two color coat coverage over base coat: 80%

Surface tension of two color coat: Equalized

Sheeting applied over two color coat: Yes

Optional steps: None

Overall effect: Variegated pearlescent effect

Thus since the invention disclosed herein may be embodied in other specific forms without departing from the spirit or general characteristics thereof; some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. A hand tool for spreading paint on a surface, with the hand tool being cooperable with a paint tray having a pair of receptacle portions separated by a divider, comprising:

a) a frame having proximal and distal end portions, with the proximal end portion comprising a handle for manipulating the tool;

b) a set of first and second rollers engaged to the distal end portion of the frame and rotating about respective first and second axes, with the rollers comprising respective exterior surfaces which pick up and spread paint, with the first and second rollers further comprising respective inner ends, with the inner ends of the rollers being spaced from and disposed transversely of each other such that each of the rollers rotates independently of the other, and with the axes of the rollers being generally aligned to each other and generally in a common plane such that the rollers may paint respective surface portions which lie generally planar to each other; and c) an opening defined by at least one of the frame and set of rollers, with the opening being disposed between the first and second axes and extending in each radial direction from at least one of the axes and at least to a distance defined by a radius of one of the rollers whereby the divider of the paint tray may be received in said opening and whereby the rollers may be dipped into paint in the receptacle portions on each side of the divider.

2. The hand tool of claim 1 and the frame including a pair of distal end portions, wherein the distal end portions of the frame are spaced from each other to define the opening at least in part, and wherein each of the rollers is engaged to one of the distal end portions.

3. The hand tool of claim 1 wherein the exterior surface of at least one of the rollers is roughened to contribute to a random spreading of the paint.

4. The hand tool of claim 1 wherein the exterior surface of at least one of the rollers is irregular to contribute to a random spreading of the paint.

5. The hand tool of claim 1 wherein at least one of the rollers includes a plurality of nap sections for forming the exterior surface for picking up and spreading the paint, with each of the nap sections extending less than 360° about the roller, with each of the nap sections comprising a plurality of fibers, with each of the fibers extending generally in a radial direction relative to its respective roller, and with the nap sections as a whole framing a design.

6. The hand tool of claim 5 wherein at least two of the nap portions comprise different shapes to contribute to a random spreading of the paint.

7. The hand tool of claim 5 wherein at least one of the nap sections includes a shape selected from the group of shapes consisting of pond shapes, diamond shapes, square shapes, rectangular shapes, trapezoidal shapes, triangular shapes, "U" shapes, "V" shapes, Arabic numeral shapes, wrought iron shapes, musical clef symbol shapes, endless lip and smile shapes, worm shapes, endless worm shapes, crease-like shapes, and leaf shapes.

8. The hand tool of claim 1 wherein the opening extends to a location at least adjacent the proximal end portion of the frame.

9. The hand tool of claim 1 wherein each of the exterior surfaces of the rollers comprises a cylindrical shape.

10. The hand tool of claim 1 wherein each of the exterior surfaces of the rollers comprises a set of design nap portions, with each of the design nap portions within said respective set being spaced tom other design nap portions, with each of the design nap portions comprising a plurality of fibers, with each of the fibers extending generally in a radial direction relative to the roller with which said fiber is engaged.

11. A hand tool for spreading paint on a surface, comprising:

a) a frame having proximal and distal end portions, with the proximal end portion comprising a handle for manipulating the tool;

b) a set of first and second rollers engaged to the distal end portion of the frame and rotating about respective first and second axes, with the rollers comprising respective exterior surfaces which pick up and spread paint, with the first and second rollers further comprising respective inner ends, with the inner ends being spaced from and disposed transversely of each other such that each of the rollers rotates independently of the other;

c) an opening defined by at least one of the frame and set of rollers, with the opening being disposed between the first and second axes and extending in each radial direction from at least one of the axes and at least to a distance defined by a radius of one of the rollers; and d) a receptacle for paint, with the receptacle having two receptacle portions separated from each other by a divider and being on each side of the divider such that paint in one receptacle portion is prevented from mixing with paint in the other receptacle portion, with the divider having a thickness, with the thickness of the divider being less than a width of said opening to permit the divider to be received in said opening such that one of the rollers may be dipped into paint in one of the receptacle portions and the other roller maybe dipped into paint in the other of the receptacle portions.

12. The hand tool of claim 11 wherein each of the rollers includes a diameter, wherein the divider includes a height, and wherein the height of the divider is at least that of the diameter of each of the rollers such that each of the rollers may extend into a respective receptacle portion of said roller at least to a distance defined by its respective diameter.

13. The hand tool of claim 12 wherein the axes of the rollers are generally parallel.

14. The hand tool of claim 11 and further comprising, in combination, paint in each of the receptacle portions, with paint in one of the receptacle portions having a first color and with paint in the other of the receptacle portions having a second color, with the colors being different.

15. A hand tool for spreading paint on a surface, comprising:

a) a frame comprising proximal end portion which comprises a handle for manipulating the tool, with the frame further comprising a pair of distal end portions, with the distal end portions being spaced from each other;

b) a set of first and second rollers engaged to the frame, with one of the rollers being engaged to one of the distal end portions and with the other of the roller being engaged to the other distal end portion of the frame, with the rollers rotating about respective first and second axes, with the rollers comprising respective exterior surfaces which pick up and spread paint, with the first and second rollers further comprising respective inner ends, with the inner ends of the rollers being spaced from and disposed transversely of each other such that each of the rollers rotates independently of the other, and wherein each of the rollers is engagable on a respective distal end portion of the frame in at least two axially different positions such that the distance between the inner ends of the rollers may vary; and c) an opening defined by at least one of the frame and set of rollers, with at least part of the opening being defined by the distal end portions of the frame, with the opening being disposed between the first and second axes and extending in each radial direction from at least one of the axes and at least to a distance defined by a radius of one of the rollers such that a paint tray divider may be received in said opening and such that the rollers may be dipped into paint in paint receptacle portions on each side of the divider.

16. A hand tool for spreading paint on a surface, comprising:

a) a frame having proximal and distal end portions, with the proximal end portion comprising a handle for manipulating the tool;

b) a set of first and second rollers engaged to the distal end portion of the frame and rotating about respective first and second axes, with the rollers comprising respective exterior surfaces which pick up and spread paint, with the first and second rollers further comprising respective inner ends, with the inner ends of the rollers being spaced from and disposed transversely of each other such that each of the rollers rotates independently of the other; and c) an opening defined by at least one of the frame and set of rollers, with the opening being disposed between the first and second axes and extending in each radial direction from at least one of the axes and at least to a distance defined by a radius of one of the rollers such that a paint tray divider may be received in said opening and such that the rollers may be dipped into paint in paint receptacle portions on each side of the divider; and d) wherein one of the rollers includes a cylindrical nap portion for picking up and spreading paint, with the cylindrical portion being elongate, and wherein the other roller includes design nap portions which are spaced from each other.

17. A bifurcated paint roller and bifurcated paint tray hand tool combination, comprising:

a) a bifurcated paint roller which comprises:

1) a frame having proximal and distal end portions, with the proximal end portion having a handle for manipulating the tool;

2) a set of first and second rollers engaged to the distal end portion of the frame and rotating about respective first and second axes, with the rollers having respective first and second nap portions which pick up and spread paint, with the first and second rollers having respective inner ends, with the inner ends being spaced from and disposed transversely of each other such that each of the rollers rotates independently of the other; and 3) with at least one of the frame and set of rollers defining an open ended slot splitting the axes and running into the frame at least to a distance defined by a radius of one of the rollers, with the open ended slot having a width and a depth; and b) a bifurcated paint tray which comprises at least two receptacle portions separated from each other by a divider such that paint in one receptacle portion is prevented from mixing with paint in the other receptacle portion, with the divider having a width and a height, with the width of the divider being less than the width of the open ended slot to permit the divider to be received in such open ended slot such that one of the nap portions may be dipped into one of the receptacle portions and the other nap portion may be dipped into the other receptacle portion.

18. The bifurcated paint roller and bifurcated paint tray hand tool combination of claim 17, wherein each of the nap portions comprises intertwined fibers.

19. The bifurcated paint roller and bifurcated paint tray hand tool combination of claim 17, wherein the tray includes a first roughened surface portion at a first general elevation for engaging the nap portions and a second roughened surface portion at a second general elevation for engaging the nap portions, with each of the roughened surface portions having a different shape, with one of the roughened surface portions being roughened by extensions extending upwardly from such surface portion and with the other of the roughened surface portions being roughened by extensions extending downwardly from such surface portion such that such other roughened surface portion forms channels.

20. A bifurcated paint roller and bifurcated paint tray hand tool combination for painting by hand, comprising:

a) a bifurcated paint roller for spreading paint on a surface, comprising:

1) a frame having proximal and distal end portions, with the proximal end portion having a handle for manipulating the tool in a first direction of spreading the paint; and 2) first and second rollers engaged to the distal end portion of the frame and rotating about respective first and second axes, with the first and second rollers having respective exterior surfaces which pick up and spread paint, with the first and second rollers having respective inner ends, with the inner ends being spaced from and disposed transversely of each other such that each of the first and second rollers rotates independently of the other, with each of the rollers having a radius;

3) an opening in the distal end portion of the frame, with at least a portion of the opening being disposed between the inner ends of the rollers, with the opening having a width and a depth; and b) a bifurcated paint tray, comprising: at least two receptacle portions separated from each other by a divider such that paint in one receptacle is prevented from flowing to the other receptacle portion, with the divider having a width and a height, with the width of the divider being less than the distance between the inner ends of the rollers such that the rollers may be dipped into paint in the receptacles and such that at least a portion of the opening receives the divider, and with the height of the divider being greater than the radius of each of the rollers such that each of the rollers may be dipped into the receptacle a distance beyond the radius of said roller.

21. The bifurcated paint roller and bifurcated paint tray hand tool combination of claim 20 and further comprising another distal end portion, with each of the distal end portions having one of the rollers engaged thereto, and wherein the opening comprises an open-ended slot defined at least in part by the distal end portions of the frame.

22. The bifurcated paint roller and bifurcated paint tray hand tool combination of claim 21 wherein the open ended slot is generally aligned with the handle.

23. The bifurcated paint roller and bifurcated paint tray hand tool combination of claim 20 and further comprising paint in each of the receptacle portions, with paint in one of the receptacle portions being of a different color than paint in the other of the receptacle portions.

24. The bifurcated paint roller and bifurcated paint tray hand tool combination of claim 20 and further comprising another distal end portion, with each of the distal end portions having a section extending from the inner end of one respective roller, with each of the sections subsequently extending in a direction generally toward the handle, and with each of the sections at least partially defining such opening.

25. A hand tool in combination with a paint tray for spreading paint on a surface, with the hand tool being cooperable with the paint tray, the paint tray having a pair of receptacle portions separated by a divider, comprising:

a) a frame having proximal and distal end portions, with the proximal end portion comprising a handle for manipulating the tool;

b) a set of first and second rollers engaged to the distal end portion of the frame and rotating about respective first and second axes, with the rollers comprising respective exterior surfaces which pick up and spread paint, with the first and second rollers further comprising respective inner ends, with the inner ends of the rollers being spaced from and disposed transversely of each other such that each of the rollers rotates independently of the other; and c) an opening defined by at least one of the frame and set of rollers, with the opening being disposed between the first and second axes and extending in each radial direction from at least one of the axes and at least to a distance defined by a radius of one of the rollers such that the divider of the paint tray may be received in said opening and such that the rollers may be dipped into paint in the receptacle portions on each side of the divider; and d) wherein each of the rollers includes a nap having design nap portions for picking up and spreading paint, and wherein the design nap portions of each of said naps are spaced from each other.

* * * * *